US011293275B2

(12) United States Patent
Zhang et al.

(10) Patent No.: US 11,293,275 B2
(45) Date of Patent: Apr. 5, 2022

(54) RECORDING DEVICE FOR MEASURING DOWNHOLE PARAMETERS

(71) Applicant: Smith International, Inc., Houston, TX (US)

(72) Inventors: Pusheng Zhang, Cypress, TX (US); Audrey Cherel, Houston, TX (US); Baozhong Yang, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 88 days.

(21) Appl. No.: 16/401,305

(22) Filed: May 2, 2019

(65) Prior Publication Data

US 2019/0338630 A1 Nov. 7, 2019

Related U.S. Application Data

(60) Provisional application No. 62/666,720, filed on May 4, 2018.

(51) Int. Cl.
*E21B 47/017* (2012.01)
*E21B 47/12* (2012.01)
(Continued)

(52) U.S. Cl.
CPC ..... *E21B 47/017* (2020.05); *E21B 17/10* (2013.01); *E21B 41/00* (2013.01); *E21B 47/12* (2013.01); *E21B 47/26* (2020.05)

(58) Field of Classification Search
CPC ..... E21B 17/10; E21B 47/017; E21B 47/26; E21B 47/12; E21B 47/013; E21B 47/0175; E21B 47/138
See application file for complete search history.

(56) References Cited

U.S. PATENT DOCUMENTS 6,206,108 B1 3/2001 MacDonald et al.
7,168,506 B2 1/2007 Boucher et al.
(Continued)

FOREIGN PATENT DOCUMENTS

WO 2009132281 A1 10/2009
WO 2010036832 A2 4/2010

OTHER PUBLICATIONS

Endres, LA, Computation Modeling of Drill Bits: A New Method for Reproducing Bottom Hole Geometry and a Second-order Explicit Integrator via Composition for Coupled Rotating Rigid Bodies, Doctoral Thesis, University of California, San Diego, 2007, 183 pages.

(Continued)

*Primary Examiner* — Catherine Loikith

(57) ABSTRACT

A downhole recording device includes a housing centralizer, a housing, at least one radial connector connecting the housing to the housing centralizer, and an annular space between the housing centralizer and housing. The housing centralizer has a first end and a second end with a longitudinal opening through the housing centralizer from the first end to the second end. The housing is positioned radially within the longitudinal opening. The housing is configured to receive a downhole sensor. The annular space is located in the longitudinal opening of the housing centralizer and allows fluid communication from the first end of the housing centralizer to the second end of the housing centralizer.

20 Claims, 16 Drawing Sheets

(51) Int. Cl.

| | |
|---|---|
| ***E21B 47/26*** | (2012.01) |
| ***E21B 41/00*** | (2006.01) |
| ***E21B 17/10*** | (2006.01) |

(56) References Cited

U.S. PATENT DOCUMENTS

| | | | | |
|---|---|---|---|---|
| 7,172,038 | B2 | 2/2007 | Terry et al. | |
| 7,357,178 | B2 * | 4/2008 | Thornton | E21B 17/1042 166/241.6 |
| 7,497,276 | B2 | 3/2009 | Pastusek et al. | |
| 7,506,695 | B2 | 3/2009 | Pastusek et al. | |
| 7,510,026 | B2 | 3/2009 | Pastusek et al. | |
| 7,604,059 | B2 * | 10/2009 | Thornton | E21B 17/1042 166/241.6 |
| 7,604,072 | B2 | 10/2009 | Pastusek et al. | |
| 7,730,967 | B2 | 6/2010 | Ballantyne et al. | |
| 7,849,934 | B2 | 12/2010 | Pastusek et al. | |
| 7,866,413 | B2 | 1/2011 | Stauffer et al. | |
| 7,987,925 | B2 | 8/2011 | Pastusek et al. | |
| 8,100,196 | B2 | 1/2012 | Pastusek et al. | |
| 8,170,851 | B2 | 5/2012 | Rodney | |
| 8,487,626 | B2 | 7/2013 | Khan et al. | |
| 9,464,487 | B1 | 10/2016 | Zurn | |
| 9,494,031 | B2 | 11/2016 | Kelsall et al. | |
| 2001/0045300 | A1 | 11/2001 | Fincher et al. | |
| 2005/0015230 | A1 | 1/2005 | Centala et al. | |
| 2006/0272859 | A1 | 12/2006 | Pastusek et al. | |
| 2007/0272442 | A1 | 11/2007 | Pastusek et al. | |
| 2008/0066959 | A1 | 3/2008 | Pastusek et al. | |
| 2012/0031669 | A1 | 2/2012 | Foster | |
| 2013/0068525 | A1 | 3/2013 | DiGiovanni | |
| 2013/0147633 | A1 | 6/2013 | Sumrail et al. | |
| 2014/0039854 | A1 | 2/2014 | Huang | |
| 2014/0122034 | A1 | 5/2014 | Hanson et al. | |
| 2014/0136168 | A1 | 5/2014 | Spencer et al. | |
| 2015/0083493 | A1 | 3/2015 | Wassell | |
| 2016/0290117 | A1 | 10/2016 | Dykstra et al. | |

OTHER PUBLICATIONS

Richardson, DA, A Gyroscope Guidance Sensor for Ultra-deepwater Applications, 2014 Offshore Technology Conference, May 5, 2014.

Tian-Shou, M et al., Development and Use of a Downhole System for Measuring Drilling Engineering Parameters, Chemistry and Technology of Fuels and Oils; 51(3): 294-307, Jul. 1, 2015.

Haidari, Ahmad, Simulation and sensors advance the digital oilfiled. Offshore Magazine, 73(5), May 1, 2013, 2 pages.

* cited by examiner

RECORDING DEVICE FOR MEASURING DOWNHOLE PARAMETERS

CROSS-REFERENCE TO RELATED APPLICATIONS

This application claims priority to U.S. Provisional Patent Application having Ser. No. 62/666,720, which was filed on May 4, 2018 and is incorporated herein by reference in its entirety.

BACKGROUND

In underground drilling, a drill bit is used to drill a wellbore into subterranean formations. The drill bit is attached to sections of pipe that reach back to the surface. The attached sections of pipe are connected to other downhole tools and are collectively called the drill string. The section of the drill string that is located near the bottom of the borehole is called the bottomhole assembly (BHA). The BHA typically includes the drill bit, sensors, batteries, telemetry devices, and other equipment located near the drill bit. A drilling fluid, sometimes called drilling mud, is provided from the surface to the drill bit through the pipe that forms the drill string. The primary functions of the drilling fluid are to cool the drill bit and carry drill cuttings away from the bottom of the borehole and up through the annulus between the drill string and the borehole wall. Sensors may be placed in the BHA or on the drill bit to measure downhole drilling parameters or other parameters.

SUMMARY

In some embodiments, a downhole recording device includes a housing centralizer, a housing, at least one radial connector connecting the housing to the housing centralizer, and an annular space between the housing centralizer and housing. The housing centralizer has a first end and a second end with a longitudinal opening through the housing centralizer from the first end to the second end. The housing is positioned radially within the longitudinal opening. The housing is configured to receive a downhole sensor. The annular space is located in the longitudinal opening of the housing centralizer and allows fluid communication from the first end of the housing centralizer to the second end of the housing centralizer.

In some embodiments, a downhole tool includes a downhole tool with a central bore and a downhole recording device positioned in the central bore. The downhole recording device includes a housing centralizer, a housing, at least one radial connector connecting the housing to the housing centralizer, and an annular space between the housing centralizer and housing. The housing centralizer has a first end and a second end with a longitudinal opening through the housing centralizer from the first end to the second end. The housing is positioned radially within the longitudinal opening. The housing is configured to receive a downhole sensor. The annular space is located in the longitudinal opening of the housing centralizer and allows fluid communication from the first end of the housing centralizer to the second end of the housing centralizer.

In some embodiments, a downhole system for measuring downhole parameters includes a bit having a central bore and a rotational axis and a downhole recording device positioned in the central bore. The downhole recording device includes a housing centralizer, a housing, at least one sensor in the housing, at least one radial connector connecting the housing to the housing centralizer, and an annular space between the housing centralizer and housing. The housing centralizer has a first end and a second end with a longitudinal opening through the housing centralizer from the first end to the second end. The housing is positioned radially within the longitudinal opening. The housing is configured to receive a downhole sensor. The annular space is located in the longitudinal opening of the housing centralizer and allows fluid communication from the first end of the housing centralizer to the second end of the housing centralizer.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 3-1 is a perspective view of the recording device of FIG. 2, according to at least one embodiment of the present disclosure;

FIG. 3-2 is another perspective view of the recording device of FIG. 3-1, according to at least one embodiment of the present disclosure;

FIGS. 9-1 to 9-3 are radial cross-sectional views recording devices, according to additional embodiments of the present disclosure;

DETAILED DESCRIPTION

Figure 1:
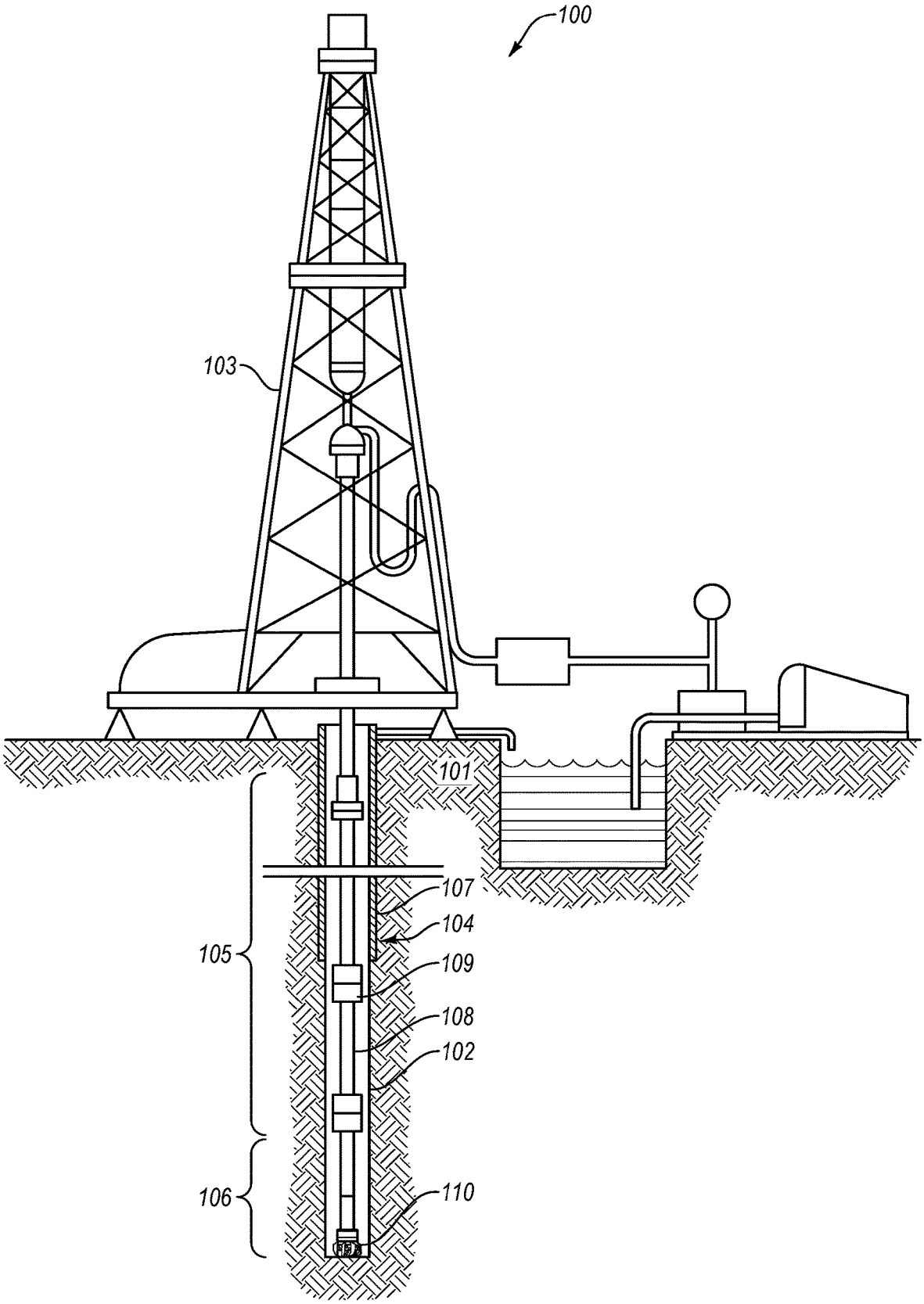
FIG. 1 schematically illustrates a general drilling station, according to at least one embodiment of the present disclosure.

This disclosure generally relates to devices, systems, and methods for measuring downhole parameters from the longitudinal and rotational axis of a bit while drilling. FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on the locations of the components in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
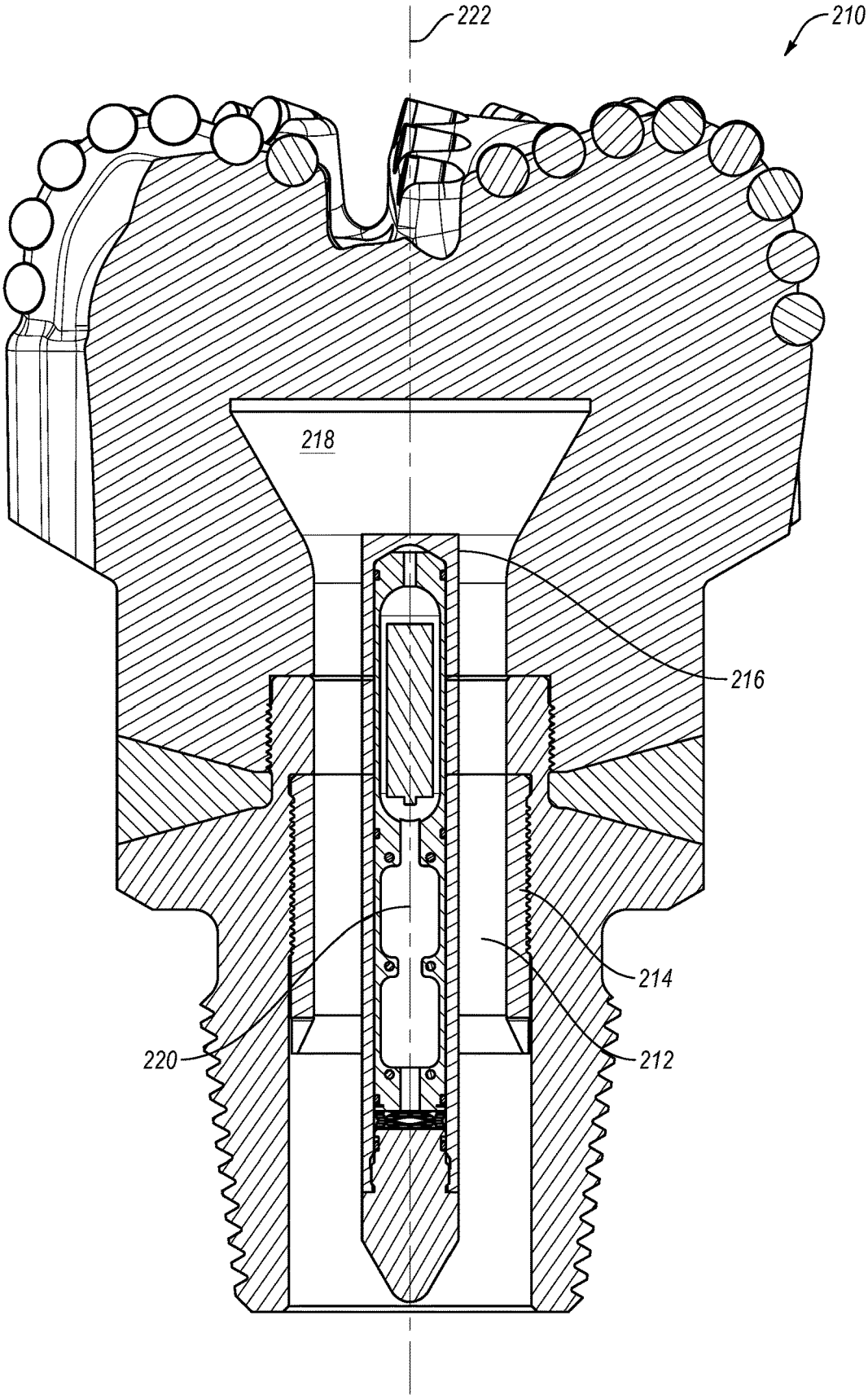
FIG. 2 is a cross-sectional view of a bit and a recording device, according to at least one embodiment of the present disclosure.

FIG. 2 is a side cross-sectional view of an embodiment of a bit 210, according to the present disclosure. The bit 210 includes a recording device 212. The recording device 212 may include a housing centralizer 214 and a housing 216. In some embodiments, the recording device 212 is placed in a central bore 218 of the bit 210.

The housing 216 has a longitudinal axis 220, and the central bore 218 has a longitudinal axis 222. In some embodiments, the longitudinal axis 220 of the housing 216 is the same as (i.e., coaxial with) the longitudinal axis 222 of the bore. In some embodiments, the longitudinal axis 222 is the same as a rotational axis of the bit 210. In other words, the bit 210 may rotate around the longitudinal axis 222. In some embodiments, the recording device 212 is rotationally fixed with respect to the bit 210.

Figures 2, 3:
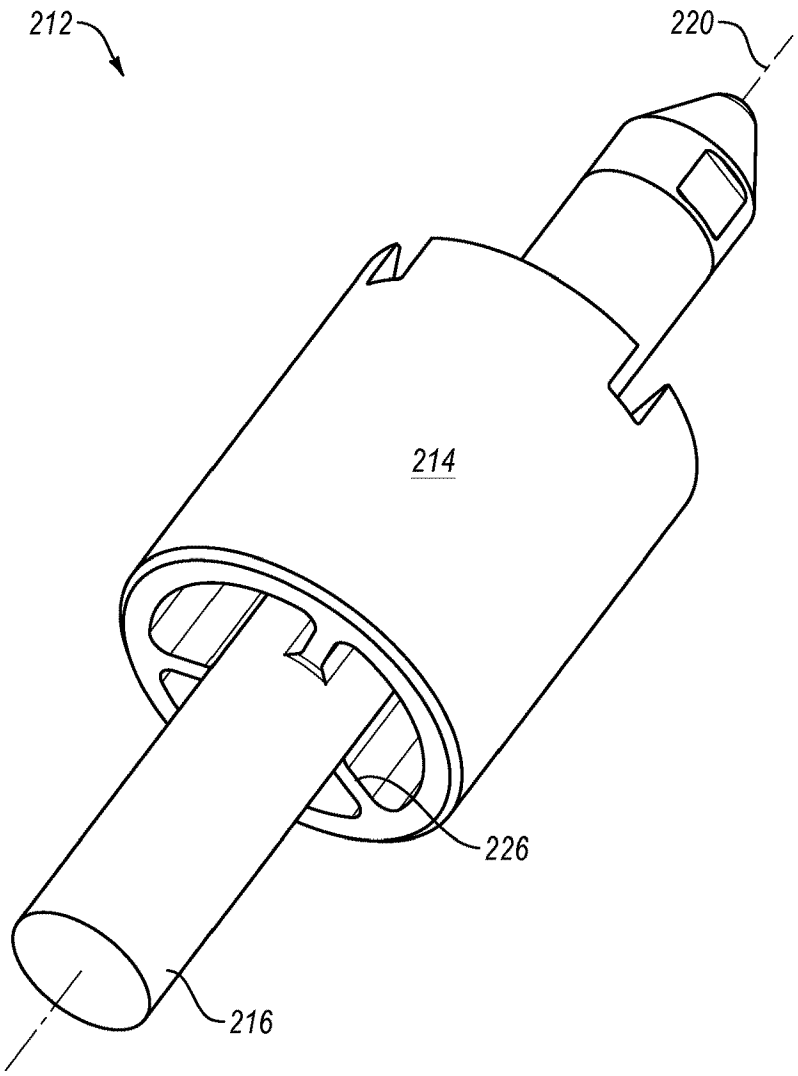
Figures 1, 3:
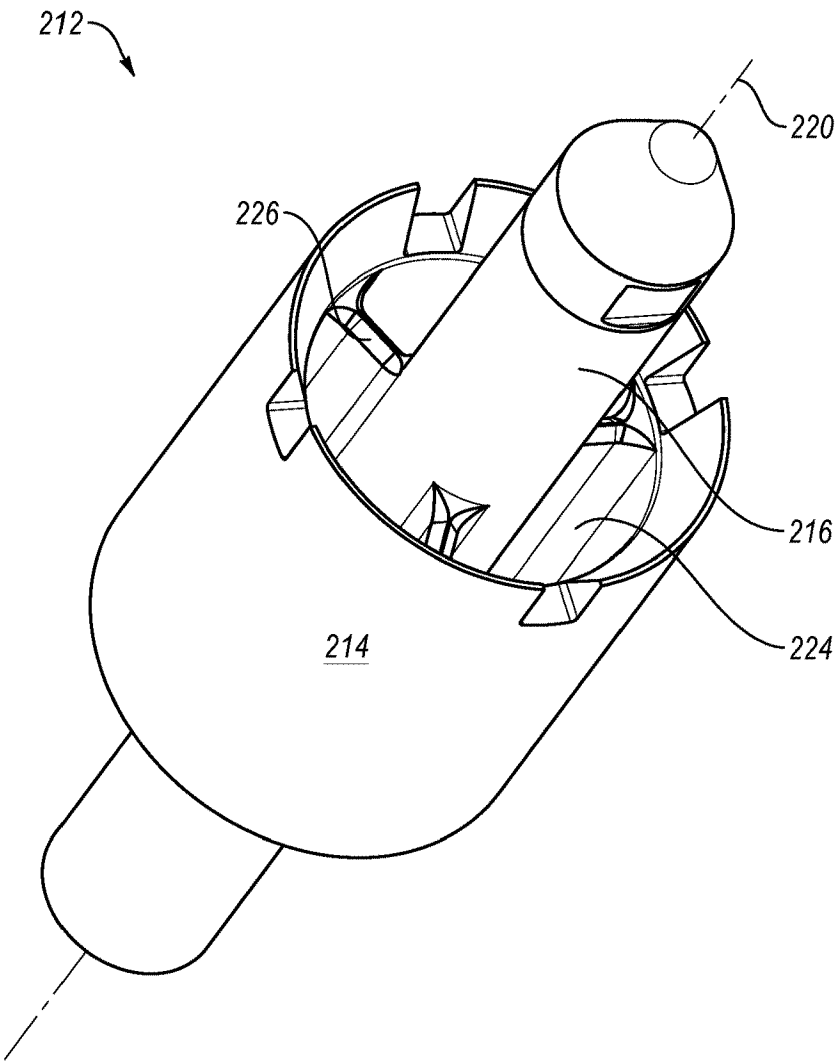

FIG. 3-1 is a top perspective view of the embodiment of a recording device 212 of FIG. 2. In some embodiments, the housing centralizer 214 is generally cylindrical. In other embodiments, the housing centralizer 214 has a non-circular cross-sectional shape, such as a square, rectangular, pentagonal, octagonal, other polygonal, elliptical, other curved, irregular, or other non-circular cross-sectional shape. The housing centralizer 214 may have an annular space 224 radially around the housing 216 and extending axially in the direction of the longitudinal axis 220. The annular space 224 may provide fluid communication through the housing centralizer 214 around the housing 216. In some embodiments, the housing 216 is generally cylindrical in shape. The housing 216 may be located in the annular space 224 and supported by at least one connector 226. In some embodiments, the housing 216 is radially centered in the housing centralizer 214. In other words, the housing 216 may be located in the middle of the housing centralizer 214 and extend coaxially along the housing longitudinal axis 220.

In some embodiments, the housing centralizer 214, housing 216, at least one connector 226, or combinations thereof are made from a wear or erosion resistant material. For example, the housing centralizer 214, housing 216, at least one connector 226, or combinations thereof may be made from a hardened steel, such as tool steel. In other examples, the housing centralizer 214, housing 216, at least one connector 226, or combinations thereof are made from a metal carbide, such as tungsten carbide (WC) or titanium carbide (TiC). In still other examples, the housing centralizer 214, housing 216, at least one connector 226, or combinations thereof are made from polycrystalline diamond (PCD) or cubic boron nitride (cBN). In some embodiments, the housing centralizer 214, housing 216, at least one connector 226, or combinations thereof are made from the same material. In other embodiments, the housing centralizer 214, housing 216, at least one connector 226, or combinations thereof are made from different materials. The recording device 212 may be located in the central bore of a bit, and the central bore may be exposed to drilling fluid that flows through the bit. Drilling fluid is often erosive, and therefore making the recording device 212, centralizer 214, housing 216, connector 226, or other components from a wear-resistant material may reduce the erosive effects of the drilling fluid and extend the service life of the recording device 212.

FIG. 3-2 is a bottom perspective view of the embodiment of a recording device 212 of FIG. 3-1. In some embodiments, at least one connector 226 connects the housing 216 to the housing centralizer 214 and supports the housing 216 relative to the housing centralizer 214 in each of longitudinal, radial, and rotational directions. In some embodiments, a plurality of connectors 226 connect the housing 216 to the housing centralizer 214 and support the housing 216 within the centralizer 214. For example, FIGS. 3-1 and 3-2 illustrate an embodiment of a recording device 212 having three connectors 226 positioned at equal angular intervals about the housing 216. In other embodiments, more or fewer than three connectors 226 connect the housing 216 to the housing centralizer 214. For example, any of 1, 2, 4, 5, 6, or more connectors 226 may connect the housing 216 to the housing centralizer 214. In some embodiments, the connectors 226 are positioned at equal angular intervals about the housing 216. For example, three connectors 226 may be positioned at 120° intervals, four connectors 226 may be positioned at 90° intervals, or the like. In other embodiments, the spacing may be unequal and the mass of the connectors is optionally rotationally balanced about the housing longitudinal axis 220 (see FIG. 2). For example, three connectors 226 may be positioned at unequal intervals about the longitudinal axis of the housing 216, with the interval between two less massive (e.g., thinner or shorter) connectors 226 being less than the intervals between the two thinner/shorter connectors 226 and one more massive (e.g., thicker or longer) connector 226, such that the rotational mass is balanced. In some embodiments, a drill bit is mass imbalanced, and an imbalanced recording device 212 may correct or improve the mass imbalance of the drill bit.

Figure 4:
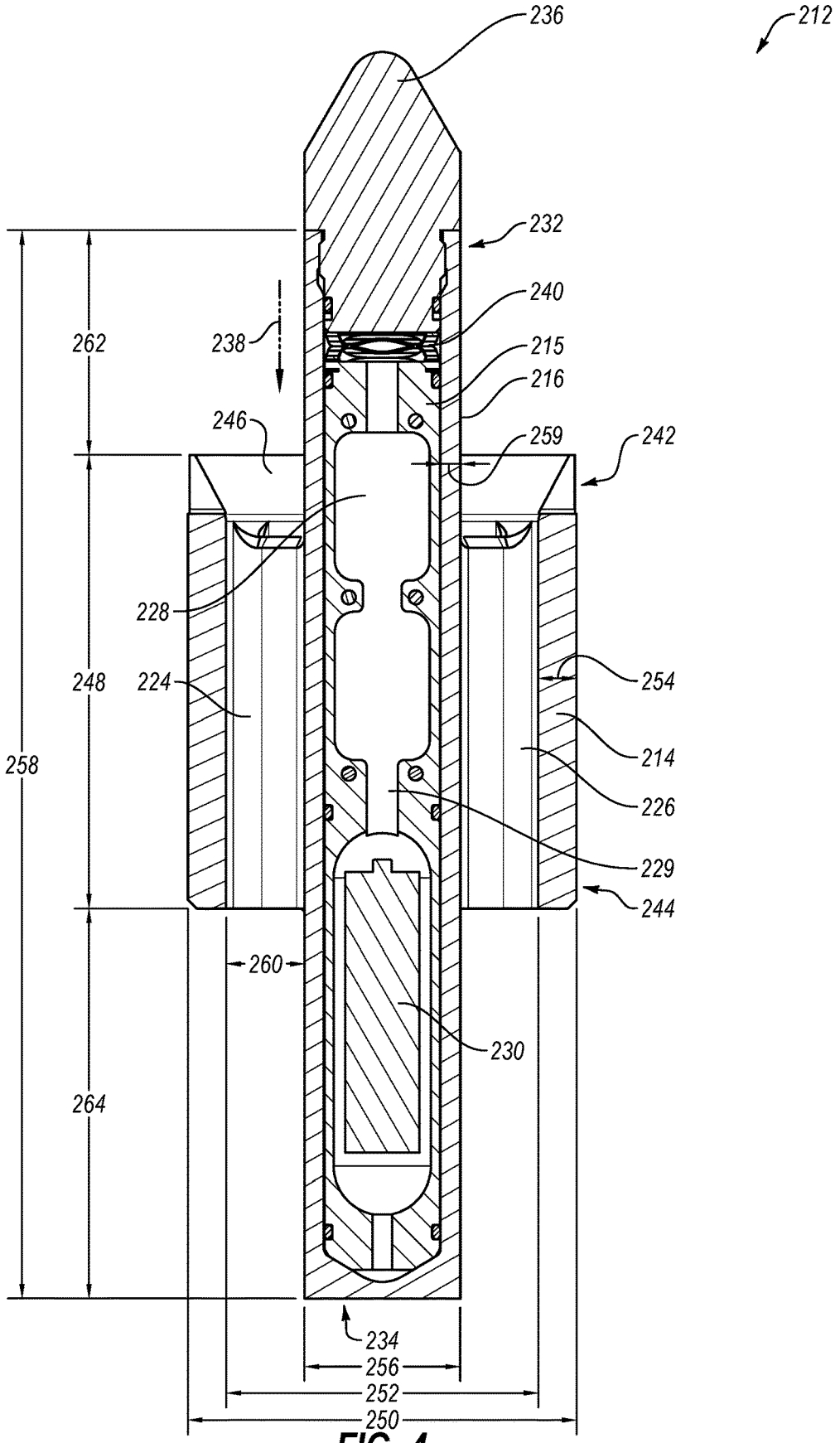
FIG. 4 is a longitudinal cross-sectional view of the recording device of FIG. 3-1, according to at least one embodiment of the present disclosure.

FIG. 4 is a longitudinal cross-sectional view of the embodiment of a recording device 212 of FIG. 2. In some embodiments, the housing 216 includes a chassis 215 with a mounting area 228 and a power source 230. In some embodiments, the mounting area 228 includes one or more sensors mounted thereto. The mounting area 228 may include more than one sensor, such as 2, 3, 4, 5, 6, or more sensors, including one or more sensors of the same or different types. In some embodiments, the mounting area 228 includes one or more of the following sensor types: temperature, accelerometer, gyroscope, real time clock, inclination, weight on bit, rotational speed, other sensors, or any combination of the foregoing.

In some embodiments, the one or more sensors in the sensor package take measurements of drilling, geological, environmental, or other parameters during drilling operations. In this manner, the sensor package may be a measurement-while-drilling package. In some embodiments, the one or more sensors in the sensor package record the measured parameters on a memory device located inside the housing 216. In other embodiments, the one or more sensors in the sensor package record the measured parameters on a memory device located outside the housing 216. For example, the measured parameters may be stored on a memory device located uphole in the BHA. In still other embodiments, the one or more sensors in the sensor package may transmit the measured parameters to the surface.

Placing the at least one sensor in the mounting area 228 in the housing 216 may allow the sensor package to be placed inside the bit, close to the cutting structure. Sensors closer to the cutting elements may collect more accurate information about the status of the bit, forces applied to the bit, movement of the bit, or the surrounding formation than sensors placed elsewhere in the BHA. More accurate drilling information may enable drilling operators to change operating parameters in response to drilling conditions, to evaluate conditions after drilling, or to allow automated evaluation and control of drilling parameters. Additionally, more accurate drilling information may help the development or selection of a more appropriate bit for given conditions. Placing the sensor package in the housing 216 may additionally allow collection of information from the rotational center of the bit. This may help protect the sensors and provide information independent of rotational interferences.

In some embodiments, the power source 230 may be a battery within the housing 216. In other embodiments, the power source 230 may be external to the housing 216, such as from a downhole power generator like a mud motor or turbine.

The housing 216 in FIG. 4 has a housing first end 232 and a housing second end 234. In some embodiments, the housing first end 232 is open and the housing second end 234 is closed. The sensor package and the power source 230 may be loaded into the housing from the open housing first end 232. The housing first end 232 may then be sealed using a plug or other sealing member 236. In some embodiments, the sensor package is located near the housing first end 232 of the housing 216, and the power source 230 is located near the housing second end 234 of the housing 216. In other embodiments, the sensor package is located near the housing second end 234, and the power source 230 is located near the housing first end 232. In some embodiments, the sensor package may be separated from the power source 230 by a separator 229. In some embodiments, the sensor package and power source 230 axially overlap, rather than being axially spaced as shown in FIG. 4.

Still referring to FIG. 4, in some embodiments, the sealing member 236 connects to the housing 216 using a threaded connection. In other embodiments, the sealing member 236 connects to the housing 216 using a press-fit connection, a mechanical connector (e.g., bolts or screws), an adhesive, or a braze or weld. In still further embodiments, the sealing member 236 may include a sealing ring, such as an O-ring, between an outer surface of the sealing member 236 and an inner surface of the housing 216. In yet further embodiments, the sealing member 236 may include any combination of one or more connection types. For example, the sealing member 236 may include a threaded connection and a sealing ring, a mechanical connector with a braze to the housing 216, or a threaded connection with a mechanical connector and a weld to the housing. In yet other examples, any combination of connections may connect the sealing member 236 to the housing 216.

In some embodiments, the sealing member 236 forms a fluid-tight seal between the interior of the housing 216 and the exterior of the housing 216. In some embodiments, the sealing member 236 forms a high-pressure seal between the interior of the housing 216 and the exterior of the housing 216. In this manner, the housing 216, in conjunction with the sealing member 236, may be a pressure housing to protect the interior of the housing 216 from the pressures experienced in the interior of a central bore 218 (see FIG. 2).

In some embodiments, the housing first end 232 is located uphole of the housing second end 234. In this manner, a flow 238 of drilling fluid may flow from the housing first end 232, through the annular space 224, and past the housing second end 234. In some embodiments, the sealing member 236 has a hydrodynamically favorable shape. For example, the sealing member 236 may be conical, frustoconical, pyramidal, hemispherical, or have a generally rounded top section. This may improve wear on the sealing member 236 and/or the housing 216. In addition, a hydrodynamically favorable shape may reduce the turbulence of the flow 238 of drilling fluid through the annular space 224, thereby reducing wear on the housing centralizer 214 and the connectors 226 and reducing unfavorable hydrodynamic effects on the recording device 212.

In some embodiments, the sealing member 236 is made from a wear-resistant material. For example, the sealing member 236 may be made from a hardened steel, such as tool steel. In other examples, the sealing member 236 may be made from an ultra-hard material, such as a metal carbide like WC or TiC, or such as PCD or cBN.

In some embodiments, the housing second end 234 is flat or mostly flat. For example, a mostly flat housing second end 234 may have a variation in the longitudinal direction that is no more than 20% of the radial width of the housing second end 234. In other examples, a mostly flat housing second end 234 may have a variation in the longitudinal direction that is no more than 10% of the radial width of the housing second end 234. If the housing second end 234 is close to the bottom of the central bore (e.g., the central bore 218 of FIG. 2), an eddy flow from impact of drilling fluid against the bottom of the central bore may produce a relatively low pressure against the second end, thereby helping to secure the recording device in place. In other embodiments, the housing second end 234 is conical, rounded, or otherwise shaped. A rounded housing second end 234 may reduce the hydrodynamic shock experienced at the end of the housing 216.

Still referring to FIG. 4, in some embodiments, a resilient member 240 is located axially between the sealing member 236 and the chassis 215 (e.g., mounting area 228). The resilient member 240 may be a wave spring, coil spring, foam, mesh, compressible polymer, or the like. Adding a resilient member 240 may reduce noise that the sensor package experiences due to impact of the flow 238 on the sealing member 236.

The housing centralizer 214 may have a housing centralizer first end 242 and a housing centralizer second end 244 at opposite axial ends of the housing centralizer 214. In some embodiments, the housing centralizer first end 242 includes an end treatment such as a chamfer, radius, or bevel (e.g., a first end bevel 246). In some embodiments, the first end bevel 246 is located on an interior of the housing centralizer 214. In other words, the first end bevel 246 may taper radially inward from the radial outside to the radial inside of the housing centralizer 214 so that the thickness of the housing centralizer first end 242 increases when moving away from the first end 242. In some embodiments, a first end bevel 246 helps reduce wear on the housing centralizer 214 and/or the connectors 226.

In some embodiments, the connectors 226 extend longitudinally from the housing centralizer first end 242 to the housing centralizer second end 244. In other embodiments, the connectors 226 extend longitudinally less than an entirety of the housing centralizer length 248. Connectors 226 having a partial length of the housing centralizer length 248 may extend from the first end 242, extend to the second end 244, begin and end offset from the first and second ends 242, 244, or have axial gaps therein. In other embodiments, the connectors 226 may extend longitudinally past the first and/or second end 242, 244 of the housing centralizer 214.

In some embodiments, the connectors 226 are made from a wear resistant material, such as those discussed herein (e.g., tool steel, WC, TiC, PCD, cBN), although any suitable material may be used. In some embodiments, the connectors 226 are made from a material with a higher wear-resistance near the housing centralizer first end 242. In this manner, the portion of the connectors 226 that has the highest exposure to the flow 238 will have greater wear protection. In some embodiments, the connectors 226 include a curved edge in the radial direction and/or the rotational direction near the first end 242 and/or the second end 244.

In some embodiments, the housing centralizer 214 has a housing centralizer length 248 in a range having an upper value, a lower value, or upper and lower values including any of 0.5 in. (1.3 cm), 1 in. (2.5 cm), 1.5 in., (3.8 cm), 2 in. (5.0 cm), 2.5 in. (6.4 cm), 3 in. (7.6 cm), 3.5 in. (8.9 cm), 4 in. (10.2 cm), 4.5 in. (11.4 cm), 5 in. (12.7 cm), 5.5 in. (14.0 cm), 6 in. (15.2 cm), 8 in. (20.4 cm), or any value therebetween. For example, the housing centralizer length 248 may be greater than 0.5 in. (1.3 cm). In another example, the housing centralizer length 248 is less than 8 in. (20.4 cm). In yet other examples, the housing centralizer length 248 is any value in a range between 0.5 in. (1.3 cm) and 8 in. (20.4 cm). In still other examples, the housing centralizer length 248 is greater than 8 in. (20.4 cm).

Still referring to FIG. 4, in some embodiments, the housing centralizer 214 has an housing centralizer outer diameter 250 in a range having an upper value, a lower value, or upper and lower values including any of 1 in. (2.5 cm), 1.5 in., (3.8 cm), 2 in. (5.0 cm), 2.5 in. (6.4 cm), 3 in. (7.6 cm), 3.5 in. (8.9 cm), 4 in. (10.2 cm), 4.5 in. (11.4 cm), 5 in. (12.7 cm), 5.5 in. (14.0 cm), 6 in. (15.2 cm), 8 in. (20.4 cm), or any value therebetween. For example, the housing centralizer outer diameter 250 may be greater than 1 in. (2.5 cm). In another example, the housing centralizer outer diameter 250 is less than 8 in. (20.4 cm). In yet other examples, the housing centralizer outer diameter 250 is any value in a range between 1 in. (2.5 cm) and 8 in. (20.4 cm). In still other examples, the housing centralizer outer diameter 250 is greater than 8 in. (20.4 cm).

In some embodiments, the housing centralizer 214 has a housing centralizer inner diameter 252 in a range having an upper value, a lower value, or upper and lower values including any of 0.75 in. (1.9 cm), 1 in. (2.5 cm), 1.5 in., (3.8 cm), 2 in. (5.0 cm), 2.5 in. (6.4 cm), 3 in. (7.6 cm), 3.5 in. (8.9 cm), 4 in. (10.2 cm), 4.5 in. (11.4 cm), 5 in. (12.7 cm), 5.75 in. (14.6 cm), 6 in. (15.2 cm), or any value therebetween. For example, the housing centralizer inner diameter 252 may be greater than 0.75 in. (1.9 cm). In another example, the housing centralizer inner diameter 252 is less than 6 in. (15.2 cm). In yet other examples, the inner diameter 252 is any value in a range between 0.75 in. (1.9 cm) and 6 in. (15.2 cm). In still other examples, the inner diameter 252 is greater than 6 in. (15.2 cm).

In some embodiments, the housing centralizer 214 has a housing centralizer thickness 254 in a range having an upper value, a lower value, or upper and lower values including any of 0.05 in. (0.13 cm), 0.1 in. (0.25 cm), 0.2 in. (0.51 cm), 0.3 in., (0.762 cm), 0.4 in. (1.02 cm), 0.5 in. (1.27 cm), or any value therebetween. For example, the housing centralizer thickness 254 may be greater than 0.05 in. (0.13 cm). In another example, the housing centralizer thickness 254 is less than 0.5 in. (1.27 cm). In yet other examples, the housing centralizer thickness 254 is any value in a range between 0.05 in. (0.13 cm) and 0.5 in. (1.27 cm). In yet other examples, the thickness 354 is less than 0.05 in. (0.13 cm) or greater than 0.5 in. (1.27 cm).

In some embodiments, the housing 216 has a housing diameter 256 in a range having an upper value, a lower value, or upper and lower values including any of 0.4 in. (1.02 cm), 0.5 in. (1.27 cm), 0.6 in. (1.52 cm), 0.7 in. (1.78 cm), 0.8 in. (2.03 cm), 0.9 in. (2.29 cm), 1 in. (2.54 cm), 1.1 in. (2.79 cm), 1.2 in. (3.05 cm), 1.3 in. (3.30 cm), 1.4 in. (3.56 cm), 1.5 in. (3.81 cm), 2.0 in. (5.08 cm), or any value therebetween. For example, the housing diameter 256 may be greater than 0.4 in. (1.02 cm). In another example, the housing diameter 256 is less than 2.0 in. (5.08 cm). In yet other examples, the housing diameter 256 is any value in a range between 0.4 in. (1.02 cm) and 2.0 in. (5.08 cm). In yet other examples, the housing diameter 256 is less than 0.4 in. (1.02 cm) or greater than 2.0 in. (5.08 cm).

In some embodiments, the housing 216 has a housing length 258 in a range having an upper value, a lower value, or upper and lower values including any of 2.5 in. (6.35 cm), 3 in. (7.6 cm), 4 in. (10.2 cm), 5 in. (12.7 cm), 6 in. (15.2 cm), 7 in. (17.8 cm), 8 in. (20.3 cm), 9 in. (22.86 cm), or any value therebetween. For example, the housing length 258 may be greater than 2.5 in. (6.35 cm). In another example, the housing length 258 is less than 9 in. (22.86 cm). In yet other examples, the housing length 258 is any value in a range between 2.5 in. (6.35 cm) and 9 in. (22.86 cm). In yet other examples, the housing length 258 is less than 2.5 in. (6.35 cm) or greater than 9 in. (22.86 cm).

Still referring to FIG. 4, in some embodiments, the housing 216 has a housing thickness 259 (i.e., a radial thickness of the housing 216 around the chassis 215) in a range having an upper value, a lower value, or upper and lower values including any of 0.05 in. (1.27 mm), 0.10 in. (2.54 mm), 0.15 in. (3.81 mm), 0.20 in. (5.08 mm), 0.25 in. (6.35 mm), or any value therebetween. For example, the housing thickness 259 may be greater than 0.05 in. (1.27 mm). In another example, the housing thickness 259 is less than 0.25 in. (6.35 mm). In yet other examples, the housing thickness 259 is any value in a range between 0.05 in. (1.27 mm) and 0.25 in. (6.35 mm). In still other embodiments, the housing thickness 259 is less than 0.05 in. (1.27 mm) or greater than 0.25 in. (6.35 mm).

In some embodiments, the annular space 224 may have an annular width 260 in a range having an upper value, a lower value, or upper and lower values including any of 0.1 in. (0.25 cm), 0.2 in. (0.51 cm), 0.3 in., (0.762 cm), 0.4 in. (1.02 cm), 0.5 in. (1.27 cm), 0.6 in. (1.52 cm), 0.7 in. (1.78 cm), 0.8 in. (2.03 cm), 0.9 in. (2.29 cm), 1 inch (2.54 cm), 1.1 in. (2.79 cm), 1.2 in. (3.05 cm), 1.3 in. (3.30 cm), 1.4 in. (3.56 cm), 1.5 in. (3.81 cm), 2.0 in. (5.08 cm), or any value therebetween. For example, the annular width 260 may be greater than 0.1 in. (0.25 cm). In another example, the annular width 260 is less than 2.0 in. (5.08 cm). In yet other examples, the annular width 260 is any value in a range between 0.1 in. (0.25 cm) and 2.0 in. (5.08 cm). In still other embodiments, the annular width 260 is less than 0.1 in. (0.25 cm) or greater than 2.0 in. (5.08 cm).

In some embodiments, the housing length 258 is the same as the housing centralizer length 248. In other embodiments, the housing length 258 is different from the housing centralizer length 248. For example, the housing length 258 may be greater than the housing centralizer length 248. In other examples, the housing length 258 is less than the housing centralizer length 248.

In some embodiments, the housing first end 232 extends past the housing centralizer first end 242 a first end extension length 262. The first end extension length 262 may be in a range having an upper value, a lower value, or upper and lower values including any of 0.1 in. (0.25 cm), 0.2 in. (0.51 cm), 0.3 in., (0.762 cm), 0.4 in. (1.02 cm), 0.5 in. (1.27 cm), 0.6 in. (1.52 cm), 0.7 in. (1.78 cm), 0.8 in. (2.03 cm), 0.9 in. (2.29 cm), 1 inch (2.54 cm), 1.1 in. (2.79 cm), 1.2 in. (3.05 cm), 1.3 in. (3.30 cm), 1.4 in. (3.56 cm), 1.5 in. (3.81 cm), 1.6 in. (4.06 cm), 1.7 in. (4.32 cm), 1.8 in. (4.57 cm), 1.9 in. (4.83 cm), 2.0 in. (5.08 cm), 2.5 in. (6.4 cm), 3.0 in. (7.6 cm), 3.5 in. (8.9 cm), 4.0 in. (10.2 cm), or any value therebetween. For example, the first end extension length 262 may be greater than 0.1 in. (0.25 cm). In another example, the first end extension length 262 is less than 4.0 in. (10.2 cm). In yet other examples, the first end extension length 262 is any value in a range between 0.1 in. (0.25 cm) and 4.0 in. (10.2 cm). In still other embodiments, the first end extension length 262 is less than 0.1 in. (0.25 cm) or greater than 4.0 in (10.2 cm).

In some embodiments, the housing second end 234 extends past the housing centralizer second end 244 a second end extension length 264. The second end extension length 264 may be in a range having an upper value, a lower value, or upper and lower values including any of 0.1 in. (0.25 cm), 0.2 in. (0.51 cm), 0.3 in., (0.762 cm), 0.4 in. (1.02 cm), 0.5 in. (1.27 cm), 0.75 in. (1.91 cm), 1 inch (2.54 cm), 1.25 in. (3.18 cm), 1.5 in. (3.81 cm), 1.75 in. (4.44 cm), 2.0 in. (5.08 cm), 2.25 in. (5.72 cm), 2.5 in. (6.35 cm), 2.75 in. (6.99 cm), 3.0 in. (7.62 cm), 3.25 in. (8.26 cm), 3.5 in. (8.89 cm), 4.0 in. (10.2 cm), or any value therebetween. For example, the second end extension length 264 may be greater than 0.1 in. (0.25 cm). In another example, the second end extension length 264 is less than 4.0 in. (10.2 cm). In yet other examples, the second end extension length 264 is any value in a range between 0.1 in. (0.25 cm) and 4.0 in. (10.2 cm). In still other examples, the second end extension length 264 is less than 0.1 in. (0.25) or is greater than 4.0 in. (10.2 cm).

Figure 5:
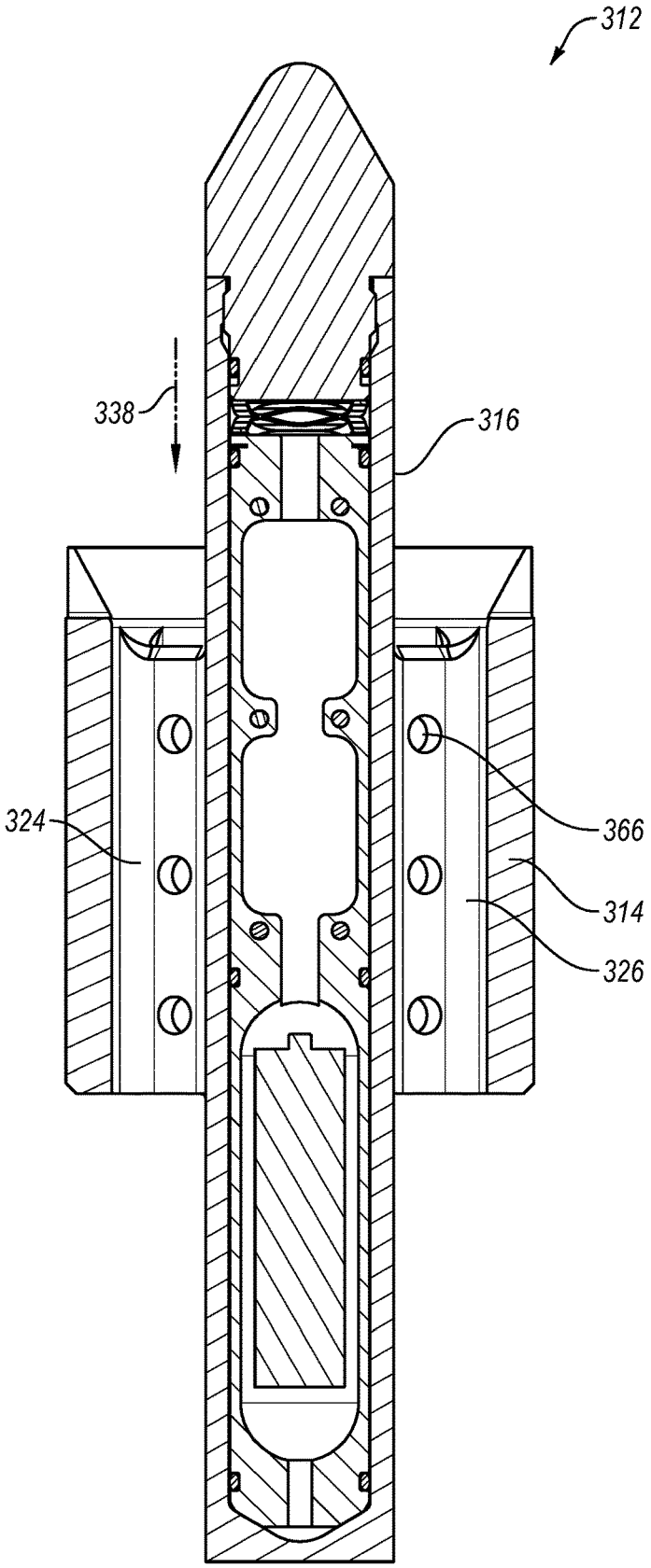
FIG. 5 is a longitudinal cross-sectional view of another recording device, according to at least one embodiment of the present disclosure.

Referring now to FIG. 5, in some embodiments, a recording device 312 includes any or each of the features and characteristics described with respect to FIGS. 2-4. The housing 316 may be secured to the housing centralizer 314 using at least one connector 326. In some embodiments, the connectors 326 include at least one window 366. Including at least one window 366 may reduce the overall weight of the recording device 312 and/or provide additional fluid flow paths within the recording device 312.

In some embodiments, the at least one window 366 may include a turbine. In some embodiments, the turbine may be used to determine the velocity of a flow 338 of drilling fluid traveling through the annular space 324. In other embodiments, the turbine may be a power turbine. In this manner, the turbine may be the power source for the sensor package. In some embodiments, the turbine may both measure flow rate and be a power turbine.

Figure 6:
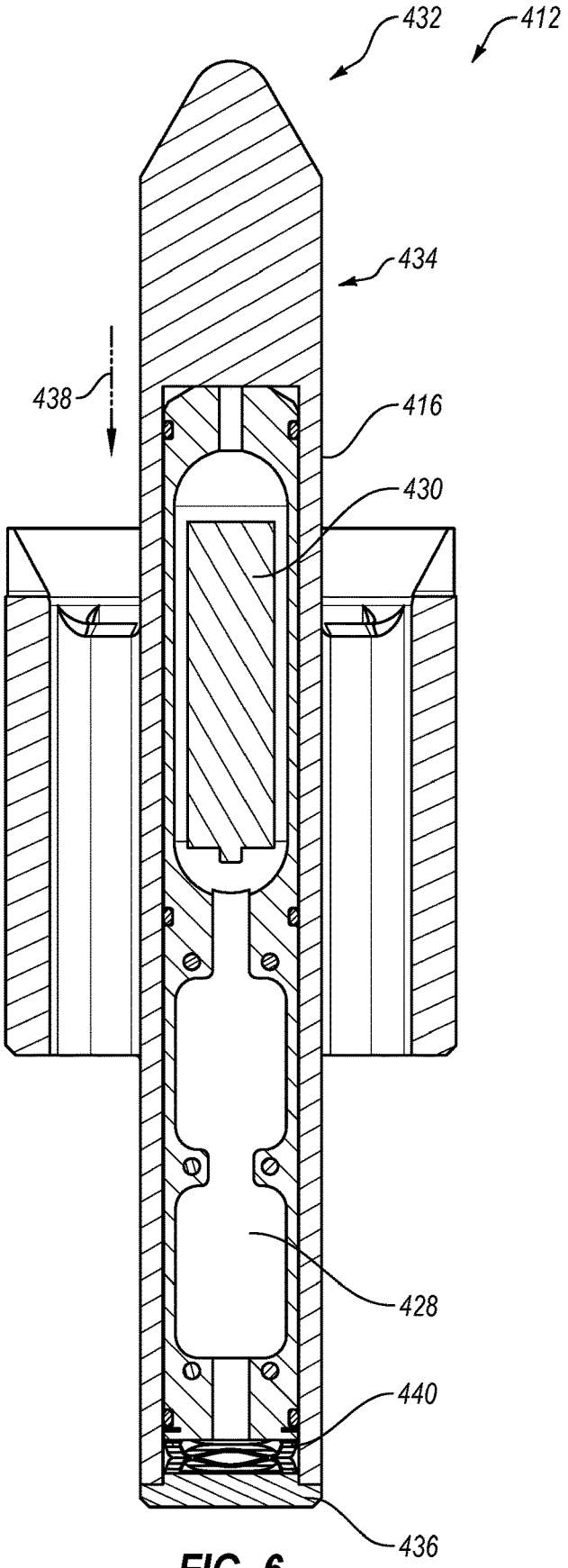
FIG. 6 is a longitudinal cross-sectional view of an additional recording device, according to at least one embodiment of the present disclosure.

FIG. 6 is a longitudinal cross-sectional view of a recording device 412, according to at least one embodiment of the present disclosure. The recording device 412 may include any or each of the features and characteristics described in relation to FIGS. 2-5, except to the extent they are mutually exclusive of those described in relation to FIG. 6. In some embodiments, a sealing member 436 is located at or near the housing second end 434, and the housing first end 432 may be closed. In this manner, the sealing member 436 may be protected from the flow 438, thereby reducing the opportunity for the sealing member 436 to fail and for drilling fluid to enter the housing 416. In some embodiments, the sealing member 436 has a flattened end. In other embodiments, the sealing member 436 has a conical or rounded end. In some embodiments, the housing first end 432 has a hydrodynamically favorable end. For example, the housing first end 432 may be conical, frustoconical, pyramidal, hemispherical, or have a generally rounded top section.

A resilient member 440 may be placed between the sealing member 436 and the interior of the housing 416. In some embodiments, the mounting area 428 is located near the housing second end 434. In other embodiments, the power source 430 is located near the housing second end 434.

Figure 7:
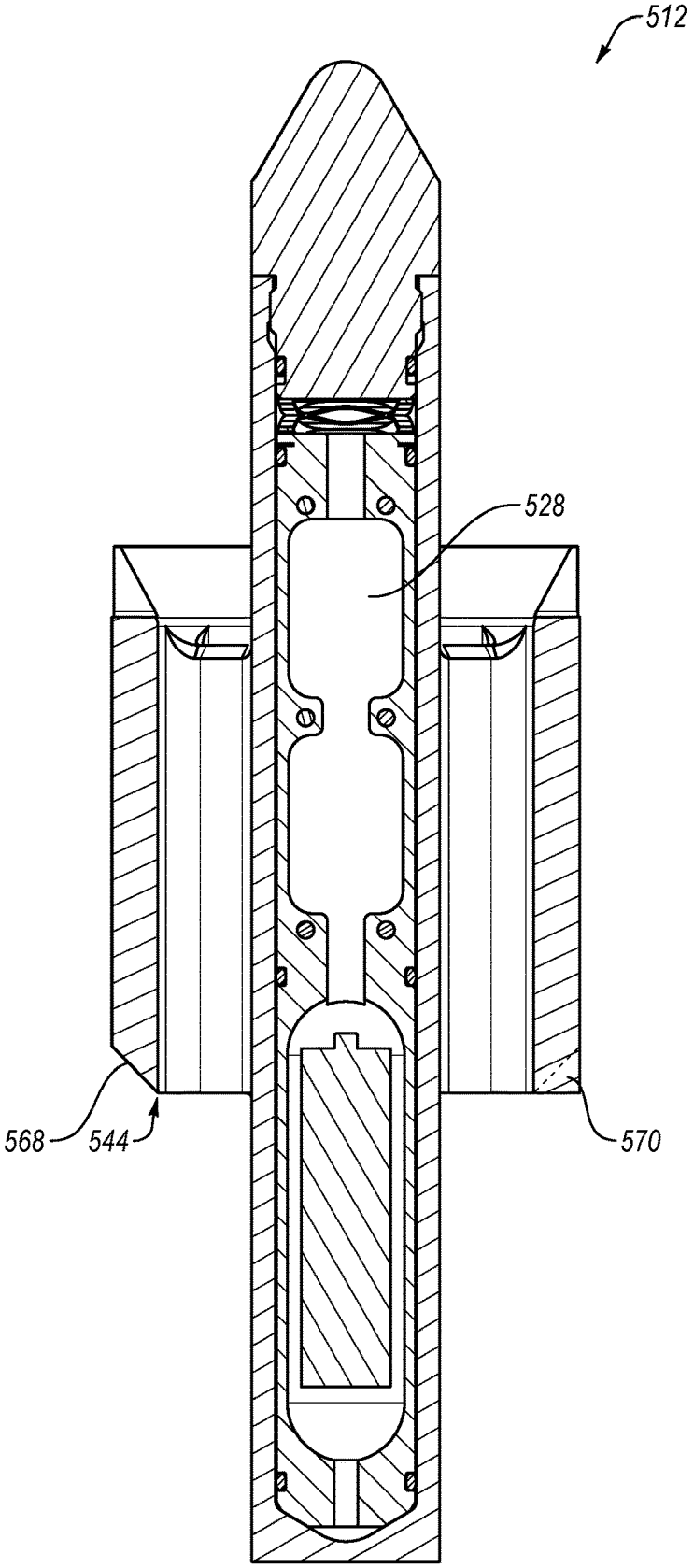
FIG. 7 is a longitudinal cross-sectional view of a further recording device, according to at least one embodiment of the present disclosure.

FIG. 7 is a longitudinal cross-sectional view of a recording device 512, according to at least one embodiment of the present disclosure. The recording device 512 may include any or each of the features and characteristics described in relation to FIGS. 2-6, except to the extent such features are mutually exclusive of those described with respect to FIG. 7. In some embodiments, the housing centralizer second end 544 includes a chamfer, radius, or bevel such as second end bevel 568. The second end bevel 568 may be located on the exterior of the housing centralizer 514, or in other words, the second end bevel 568 may extend from the interior to the exterior of the housing centralizer 514, such that the thickness of the second end 544 increases moving away from the second end 544. In some embodiments, the second end bevel 568 helps reduce wear on the housing centralizer 514 and the bit (e.g., the bit 210 of FIG. 2) at the contact of the housing centralizer second end 544 and the inner surface of the central bore (e.g., the central bore 218 of FIG. 2). In some embodiments, the housing centralizer 514 includes a first end bevel (e.g., first end bevel 246 of FIG. 4) and a second end bevel 568.

In some embodiments, the housing centralizer second end 544 includes at least one locking feature 570. In some embodiments, the at least one locking feature 570 is a protrusion of material from the housing centralizer second end 544. In other embodiments, the at least one locking feature 570 is an indentation into the housing centralizer second end 544. In still other embodiments, the at least one locking feature 570 is a discontinuity in the second end bevel 568. In other words, the at least one locking feature 570 may be portions of the housing centralizer second end 544 that are squared off to the housing centralizer second end 544, or where the housing centralizer second end 544 is not beveled. In some embodiments, the at least one locking feature 570 has a complementary locking feature located on the inner surface of the central bore (e.g., the central bore 218 of FIG. 2). In this manner, the at least one locking feature 570 and complementary locking feature of the bit may rotationally lock or couple the housing centralizer 514 with respect to and within the central bore. Stated another way, the matching locking features may transfer torque and restrict or prevent the recording device 512 from rotating relative to the bit (e.g., bit 210 of FIG. 2). Locking rotation of the recording device 512 with respect to the bit may allow a sensor package positioned in mounting area 528 to measure parameters that are dependent upon rotation of the bit, such as bit rotation speed, and some vibrational and shock parameters. Additionally, locking rotation of the recording device 512 with respect to the bit may help reduce noise caused by rotation of the recording device 512 within the bit.

Figure 8:
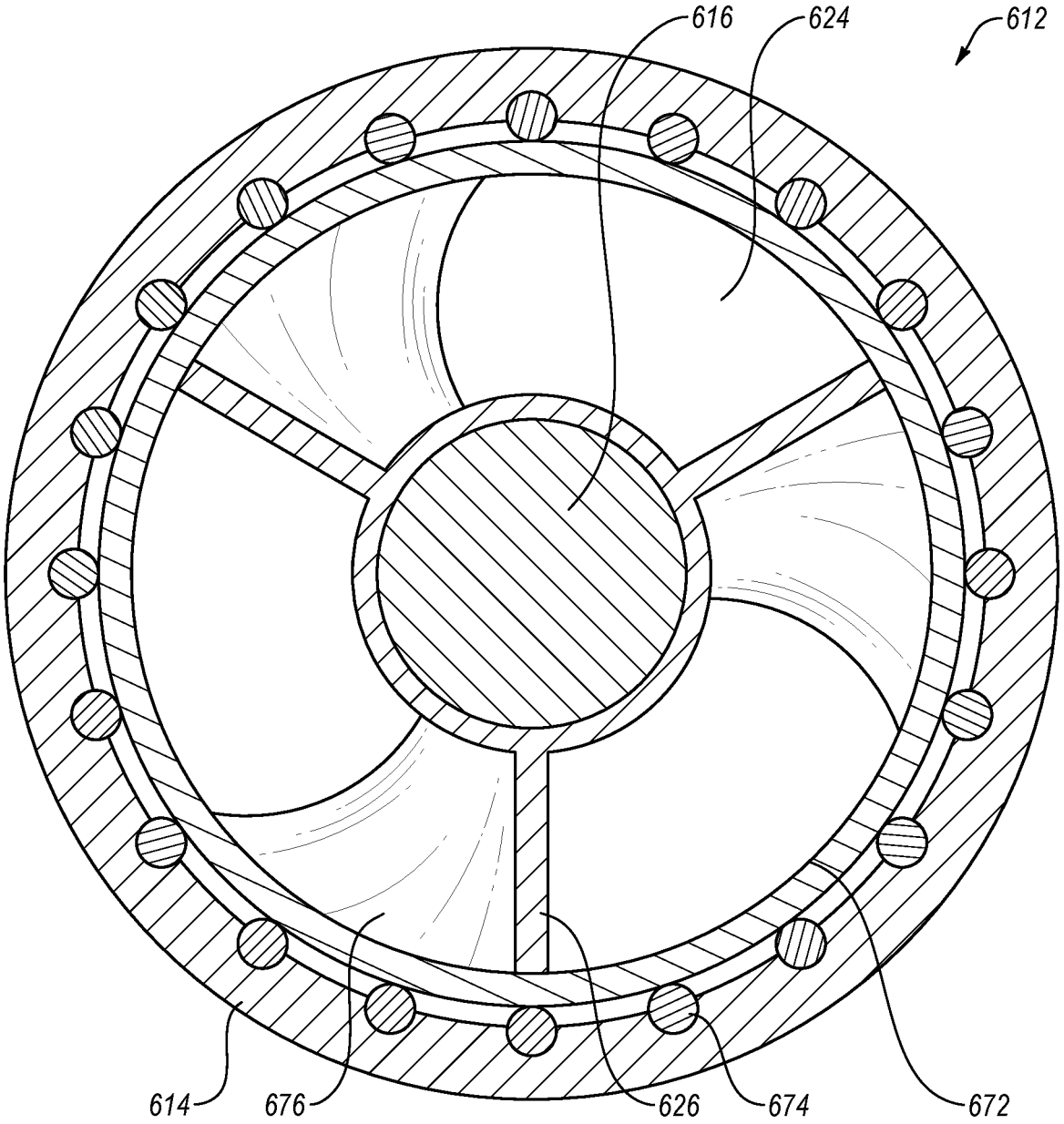
FIG. 8 is a radial cross-sectional view of a recording device, according to at least one embodiment of the present disclosure.

FIG. 8 is a radial cross-sectional view of another recording device 612, according to at least one embodiment of the present disclosure. The recording device 612 includes at least some of the features and characteristics described in relation to FIGS. 2-7, and can include any or each of such features except where such features are mutually exclusive based on the description of the embodiment of FIG. 7. In some embodiments, at least one of the connectors 626 wraps circumferentially around a portion of the circumference of the housing 616. In other words, the connectors 626 may follow a circumferential, helical, or semi-helical shape around the housing 616. Thus, the connectors 626 may be twisted at an angle and extend at least partially around the circumference of the housing 616. As shown in FIG. 8, the leading edge of the connector 626 may be straight, and the trailing edge may be curved or otherwise shaped to wrap around the housing 616. In other embodiments, the leading and trailing edges are curved, or the leading edge is curved and the trailing edge is straight.

In some embodiments, at least one of the connectors 626 wraps around a portion of the circumference of the housing 616 in a range having an upper value, a lower value, or upper and lower values including any of 15°, 30°, 60°, 90°, 120°, or any value therebetween. For example, at least one of the connectors 626 may wrap around the circumference of the housing 616 more than 15°. In another example, at least one of the connectors 626 wraps around the circumference of the housing 616 less than 120°. In other examples, at least one of the connectors 626 wraps around the circumference of the housing 616 more than 120°. In yet other examples, at least one of the connectors 626 wraps around the circumference of the housing 616 any value in a range between 15° and 120°.

At their furthest radial extent, the connectors 626 may be connected to an inner sleeve 672. The inner sleeve 672 may fit inside the housing centralizer 614. The inner sleeve 672 may be connected to the housing centralizer 614 with a rotatable connection. For example, the inner sleeve 672 may be connected to the housing centralizer 614 with a set of race bearings 674. In other examples, the inner sleeve 672 has a slip-fit connection to the housing centralizer 614, with the contact between the inner sleeve 672 and the housing centralizer being made of two low-friction materials, such as PCD. In still other embodiments, the inner sleeve 672 is connected to the housing centralizer 614 with any other rotatable connection.

When a flow of drilling fluid (e.g., flow 238 of FIG. 4) flows through the annular space 624, it may contact the contact surface 676 of the connectors 626. Contact of drilling fluid with the contact surface 676 may cause the connectors 626, the housing 616, and the inner sleeve 672 to rotate inside the housing centralizer 614. By measuring the rotational velocity of the inner sleeve 672, the flow rate of drilling fluid may be calculated. In addition, in some embodiments, the inner sleeve 672 may act as a rotor for a power generator.

In some embodiments, the contact surface 676 of the connectors 626 may be made from a wear-resistant material. For example, the contact surface 676 may be made from wear-resistant materials described herein. In some embodiments, the entire connector 626 is made from the wear-resistant material. In other embodiments, the contact surface 676 includes a coating of a wear-resistant material on the connector 626.

Figures 1, 9:
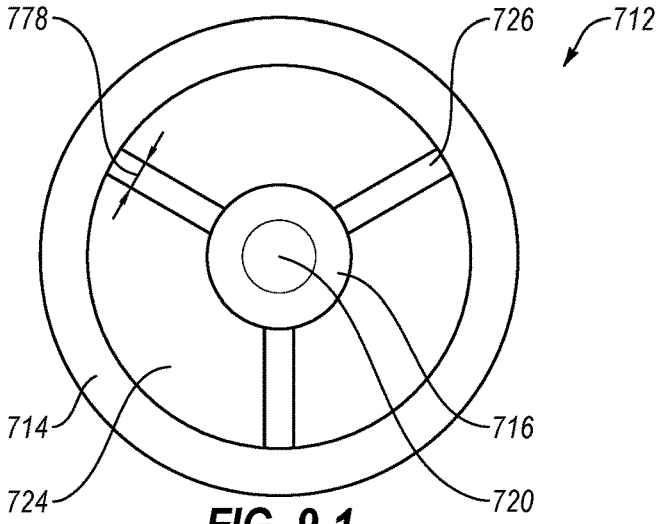
Figures 2, 9:
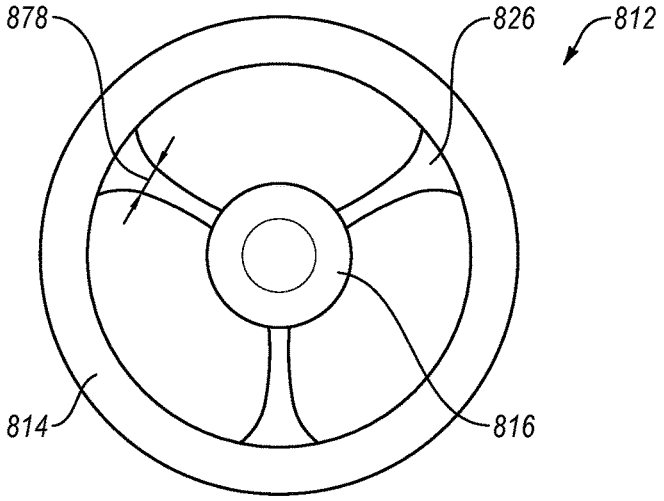
Figures 3, 9:
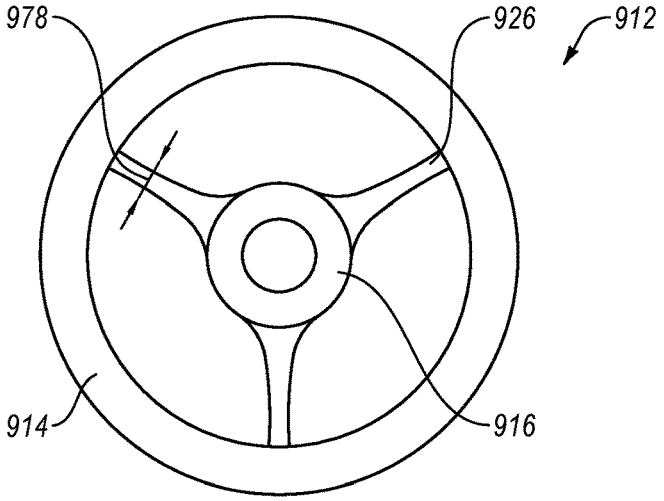

FIG. 9-1 is a radial cross-sectional view of a recording device 712, according to at least one embodiment of the present disclosure, and may be the recording device of any of FIGS. 2-8. In some embodiments, the connectors 726 are equally angularly spaced around the housing longitudinal axis 720 (e.g., three connectors 726 at 120° intervals, two connectors 726 at 180° intervals, five connectors 726 at 72° intervals, etc.). In some embodiments, the connectors 726 are equally spaced and rotationally balanced around the housing longitudinal axis 720, although the connectors 726 may be unequally spaced or rotationally or mass imbalanced as described herein.

In some embodiments, a connector 726 may have a connector thickness 778 in a range having an upper value, a lower value, or upper and lower values including any of 0.05 in. (1.27 mm), 0.10 in. (2.54 mm), 0.15 in. (3.81 mm), 0.20 in. (5.08 mm), 0.25 in. (6.35 mm), 0.30 in. (7.62 mm), 0.35 in. (8.89 mm), 0.40 in. (10.16 mm), 0.45 in. (11.43 mm), 0.50 in. (12.70 mm), or any value therebetween. For example, the connector thickness 778 may be greater than 0.05 in. (1.27 mm). In another example, the connector thickness 778 is less than 0.50 in. (12.70 mm). In still another example, the connector thickness 778 is greater than 0.5 in. In yet other examples, the connector thickness 778 is any value in a range between 0.05 in. (1.27 mm) and 0.50 in. (12.70 mm), or may be less than 0.05 in. (1.27 mm) or greater than 0.50 in. (12.70 mm). In some embodiments, each connector 726 has the same connector thickness 778. In other embodiments, one or more connectors 726 have a different connector thickness 778 than another connector 726.

One or more of the connectors 726, the housing 716, or the housing centralizer 714 may occlude, or block flow (e.g., flow 238 of FIG. 4) through a central bore (e.g., central bore 218 of FIG. 2) of a bit. The connectors 726, the housing 716, or the housing centralizer 714 may occlude, or block flow through the central bore by an occlusion percentage. For example, the occlusion percentage may be the total cross-sectional area of the housing centralizer 714, housing 716, and connectors 726 perpendicular to the longitudinal direction relative to the cross-sectional area defined by the outer diameter of the housing centralizer 714. In some embodiments, the occlusion percentage is in a range having an upper value, a lower value, or upper and lower values including any of 30%, 35%, 40%, 50%, 55%, 60%, 65%, 70%, or any value therebetween. For example, the occlusion percentage may be greater than 30%. In another example, the occlusion percentage may be less than 70%. In other examples, the occlusion percentage may be more than 30%. In yet other examples occlusion percentage may be greater than 30% and less than 70%.

The connectors 726 may be attached to the housing 716 using any of a variety of mechanisms. For example, the connectors 726 may be welded or brazed to the housing 716, attached using mechanical fasteners, or formed (e.g., cast, molded, or machined) as one piece. In further examples, the connectors 726 are inserted into a receiving slot in the housing 716. Similarly, the connectors 726 may be attached to the housing centralizer 714 using any of the same or other mechanisms.

In some embodiments, the connector thickness 778 may be constant between the housing 716 and the housing centralizer 714. In other embodiments, the connector thickness 778 may vary between the housing 716 and the housing centralizer 714. For example, referring now to the embodiment of a recording device 812 of FIGS. 9-2 and 9-3, the connector thickness 878 may be greater at the housing centralizer 814 than at the housing 816, or the connector thickness 987 may be greater at the housing 916 than at the housing centralizer 914. In some embodiments, the connector thickness 878, 978 may change smoothly between the housing 816, 916 and the housing centralizer 814, 914. For example, the connector thickness 878, 978 may change linearly, exponentially, or logarithmically between the housing 816, 916 and the housing centralizer 814, 916. In other embodiments, the connector thickness 878 changes in steps. For example, a first portion of the connector 826, 926 may have a first thickness, and a second portion of the connector 826, 926 may have a second thickness, with the connector increasing in thickness over a short space or at a right angle.

The housing centralizer end of the connectors 826, 926 connects to a housing centralizer connection percentage of the inner circumference of the housing centralizer 814, 914. In other words, the connectors 826, 926 cover a percentage of the inner circumference of the housing centralizer 814, 914. In some embodiments, the housing centralizer connection percentage may be in a range having an upper value, a lower value, or upper and lower values including any of 5%, 10%, 15%, 20%, 25%, 30%, 35%, 40%, 45%, 50%, 55%, 60%, 65%, 70%, 75%, 80%, 85%, 90%, 95%, 100%, or any value therebetween. For example, the housing centralizer connection percentage may be greater than 5%. In another example, the housing centralizer connection percentage may be less than 100%. In yet other examples housing centralizer connection percentage may be greater than 5% and less than 100%.

Figure 10:
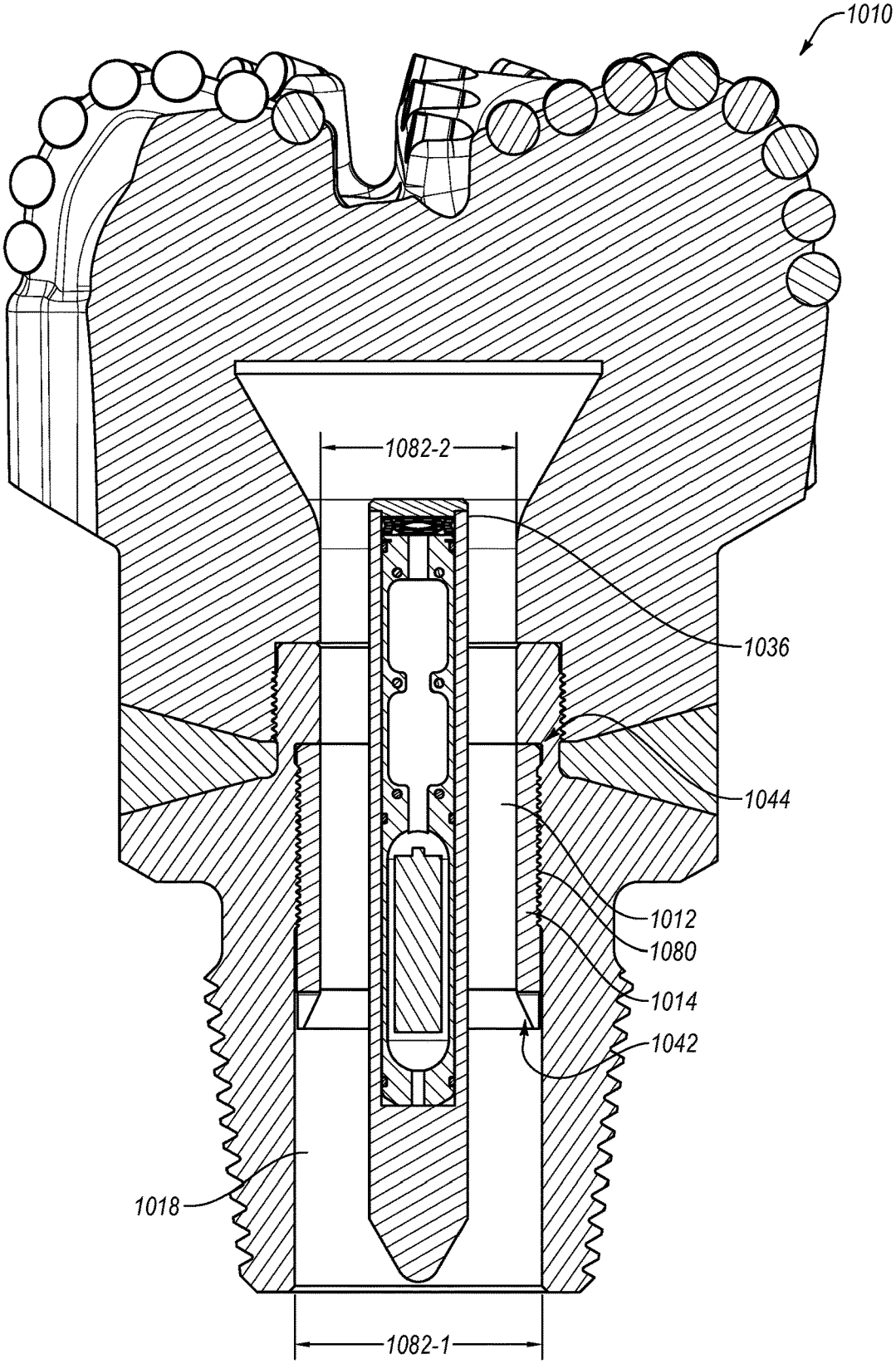
FIG. 10 is a longitudinal cross-sectional view of a bit and recording device, according to at least one embodiment of the present disclosure.

FIG. 10 is a longitudinal cross-sectional view of a bit 1010 with a recording device 1012 installed in the central bore 1018. The recording device 1012 may be any of the recording devices described in relation to FIGS. 2 to 9-3, or include any combination of features from embodiments disclosed with respect to FIGS. 2 to 9-3. In some embodiments, the recording device 1012 is connected to the bit 1010 with a threaded connection 1080. A radially outer surface of the housing centralizer 1014 may include a pin threaded connection 1080, and a matching box threaded connection 1080 may be located on an inner surface of the central bore 1018 of the bit 1010.

In some embodiments, the housing centralizer first end 1042 has a plurality of indentations. A matching set of protrusions on a wrench adapter may fit in the indentations, such that a wrench or other torque application device may be used with the wrench adapter to install the recording device 1012 in the central bore 1018. In some embodiments, the outer diameter of the housing centralizer 1014 is about the same as the first inner diameter 1082-1 of the central bore 1018, such that a sealed, threaded connection is formed when the housing centralizer 1014 is threaded into the central bore 1018 using the threaded connection 1080. In some embodiments, the recording device 1112 is replaced with a thread protector. The thread protector may have the same dimensions as the housing centralizer 1014, including the threaded connection 1080 on the outer surface of the housing centralizer 1014. However, the thread protector may not include the housing and connector(s). Thus, when the thread protector is inserted when the bit is operated without the recording device, the thread protector protects the threaded connection 1080 on the inner surface of the central bore 1018.

In some embodiments, the first inner diameter 1082-1 of the central bore 1018 is constant through the central bore 1018 until it reaches the chamber 1084. In other embodiments, the central bore 1018 has a first inner diameter 1082-1 up to the installed location of the housing centralizer second end 1044, the first inner diameter 1082-1 being slightly greater than the housing centralizer outer diameter to allow room for the threaded connection 1080. The second inner diameter 1082-2 may then be reduced to the same diameter as the housing centralizer inner diameter. In some embodiments, the housing centralizer first end 1042 includes a first end bevel (including a chamfer, round, or bevel) to gradually reduce the diameter from the first inner diameter 1082-1 to the housing centralizer inner diameter 1052. A first end bevel may reduce erosion of the housing centralizer 1014 at the housing centralizer first end 1042.

In some embodiments, the sealing member 1036 is located proximate a downhole end of the recording device 1012. In other embodiments, the sealing member 1036 is located proximate an uphole end of the recording device 1012. In still other embodiments, sealing members 1036 are located in multiple locations, including proximate uphole and downhole ends of the recording device 1012.

Figure 11:
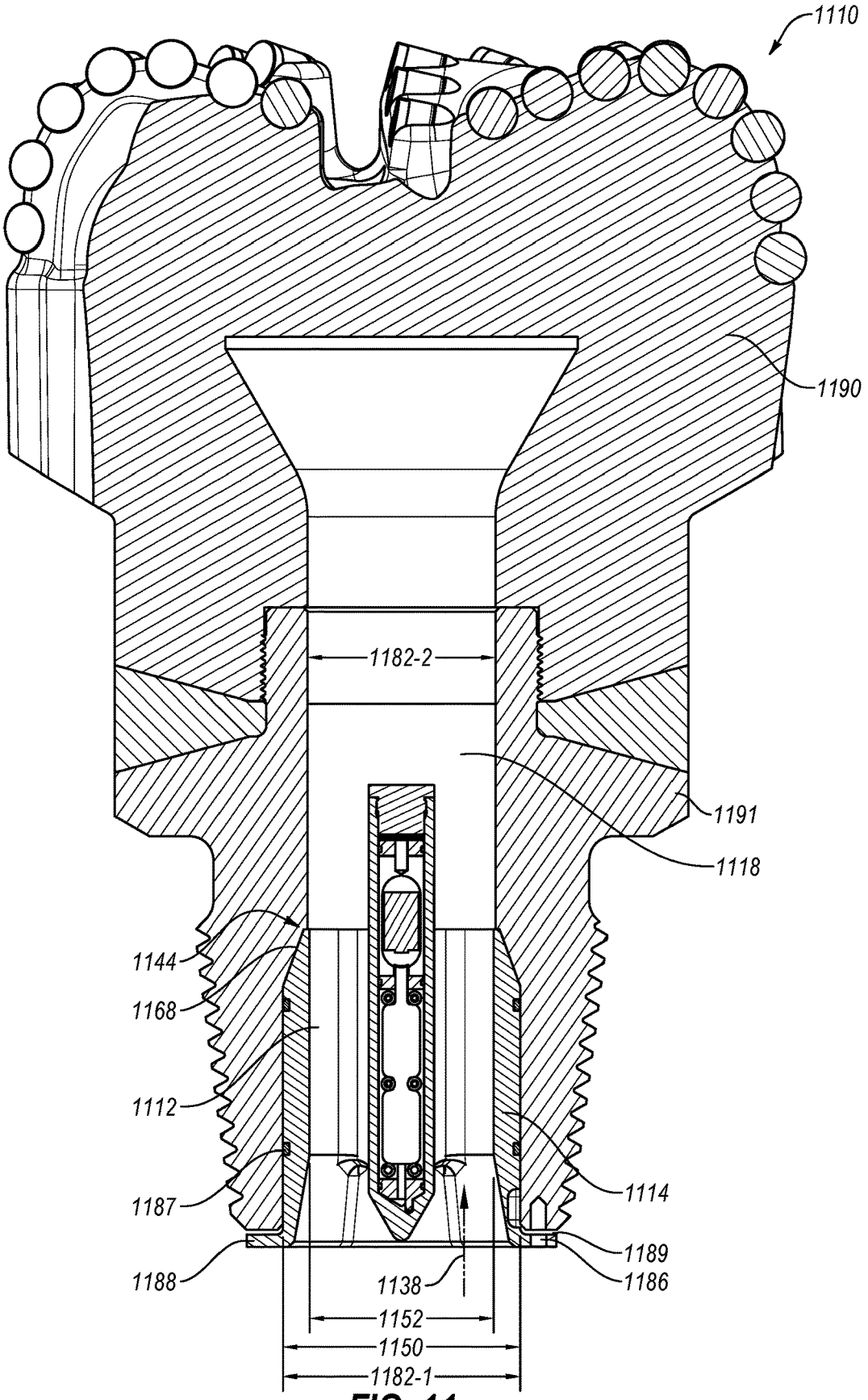
FIG. 11 is a longitudinal cross-sectional view of another bit and recording device, according to at least one embodiment of the present disclosure.

FIG. 11 is a longitudinal cross-sectional view of a bit 1110 with a recording device 1112 installed in the central bore 1118. The recording device 1112 may be the recording devices described with respect to any of FIGS. 2 to 9-3, or include any combination of features therefrom. In some embodiments, the housing centralizer 1114 is secured to the bit 1110 using one or more mechanical connectors 1186. The housing centralizer 1114 may include a first end lip 1188 extending radially past the housing centralizer outer diameter 1150 at the housing centralizer first end. The first end lip 1188 may be configured to engage an uphole end 1189 of the bit 1110. The first end lip 1188 may include one or more bores, with a matching set of one or more bores in the uphole end 1189 of the bit 1110. When the one or more bores on the first end lip 1188 line up with the one or more bores on the uphole end 1189 of the bit, the mechanical connector 1186 may be inserted into each of the one or more bores and tightened to secure the recording device 1112 to the bit 1110. In some embodiments, the lip 1188 is recessed into a recess in the uphole end 1189 of the bit 1110.

In some embodiments, the mechanical connector 1186 may be a threaded bolt. The one or more bores in the uphole end 1189 of the bit 1110 may have a matching thread through all or a part of the depth of the bore. Thus, the mechanical connector 1186 may be screwed into the bit 1110, securing the recording device 1112 to the bit 1110. In some embodiments, the one or more bores in the first end lip 1188 may have a matching thread to the mechanical connector 1186. In other embodiments, the one or more bores in the first end lip 1188 are smooth.

In some embodiments, the mechanical connector 1186 includes a bolt end protruding from the uphole end 1189 of the bit 1110. The protruding bolt ends may be aligned in a pattern matching the one or more bores in the first end lip 1188. The protruding bolt ends may be inserted into and pass through the one or more bores in the first end lip 1188, and a nut tightened on the end to secure the recording device 1112 to the bit 1110.

In some embodiments, one or more sealing rings 1187 may be positioned between the outer surface of the housing centralizer 1114 and the inside surface of the central bore 1118. The one or more seals (e.g., sealing rings 1187) may seal the annulus between the outer surface of the housing centralizer 1114 and the inside surface of the central bore 1118, thereby reducing amount of drilling fluid that flows through the space therebetween, and reducing the erosion of the outer surface of the housing centralizer 1114 and the inside wall of the central bore 1118.

The first inner diameter 1182-1 may be the same or close to the same as the housing centralizer outer diameter 1150, such that the housing centralizer 1114 forms a tight fit, or even a friction fit, with the central bore 1118. The housing centralizer 1114 may include a second end chamfer, bevel, or round (e.g., bevel 1168) at a housing centralizer second end 1144. The inside wall of the central bore 1118 may include a matching taper. The second end bevel 1168 and matching bore taper may help reduce erosion of the central bore 1118 at the housing centralizer second end 1144, or assist in centering the housing centralizer 1114 during installation in the bit 1110. In some embodiments, the second inner diameter 1182-2 is the same as the housing centralizer inner diameter 1152. Thus, a flow 1138 through the central bore 1118 may not experience a change in diameter through the bit 1110.

In some embodiments, the central bore 1118 has the same first inner diameter 1182-1 through the entire length of the central bore 1118. The recording device 1112 may have a housing centralizer outer diameter 1150 that matches the first inner diameter 1182-1, and therefore the housing centralizer inner diameter 1152 will be less than the first inner diameter 1182-1. The housing centralizer second end 1144 may include a second end radius, chamfer, or bevel extending from the interior of the housing centralizer 1114 to the exterior of the housing centralizer 1114. The second end bevel may reduce the turbulent effects of the flow 1138 as it increases in diameter from the housing centralizer inner diameter 1152 to the first inner diameter 1182-1.

In some embodiments, the bit 1110 includes a bit head 1190 and a pin 1191. The pin 1191 may be connected to the bit head 1190 using any manner of connection, including a threaded connection, mechanical connector, braze, weld, sintering or infiltration manufacturing process, integral formation, or other connection. In some embodiments, the recording device 1112 may be connected to the pin 1191 using one or more connectors, such as the mechanical connector 1186 of FIG. 11. In some embodiments, the recording device 1112 may be connected to the pin 1191 while the pin 1191 is disconnected from the bit head 1190.

Figure 12:
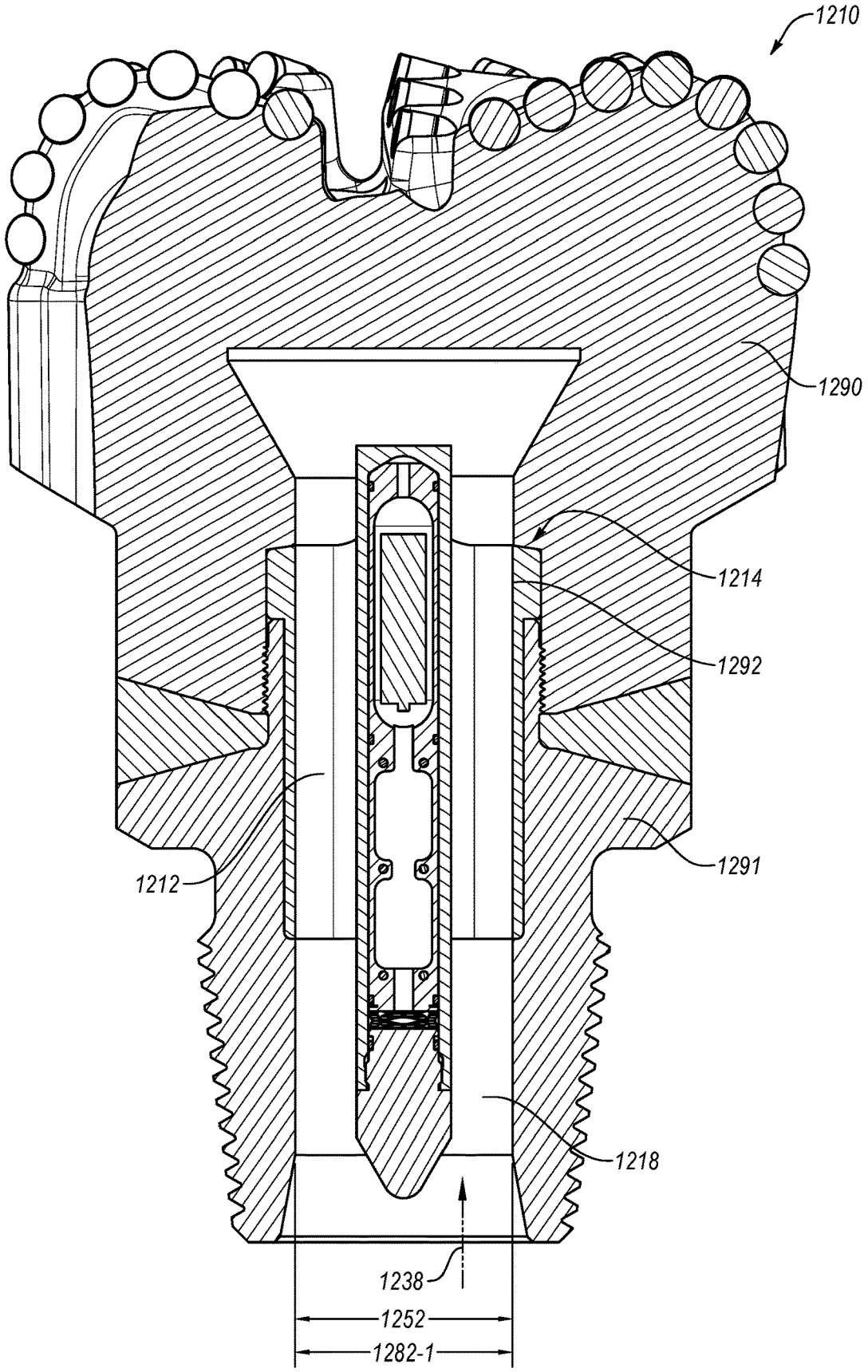
FIG. 12 is a longitudinal cross-sectional view of an additional bit and recording device, according to at least one embodiment of the present disclosure.

FIG. 12 represents a longitudinal cross-sectional view of a bit 1210 with a recording device 1212 installed in the central bore 1218. The recording device 1212 may be the recording devices described in relation to any of FIGS. 2 to 9-3, or include any combination of features therefrom. In some embodiments, the bit 1210 may include a bit head 1290 and a pin 1291 connected as discussed with respect to FIG. 11.

In some embodiments, the recording device 1212 may be installed in the bit 1210 at the time that the bit 1210 is assembled. The recording device 1212 may include a second end lip 1292 at the housing centralizer second end. The second end lip 1292 may protrude radially from the housing centralizer 1214. The second end lip 1292 may be positioned at an interface between the pin 1291 and the bit head 1290. The pin 1291 and the bit head 1290 may have a profile that, when combined, matches the profile of the housing centralizer 1214, including the second end lip 1292. When installed, the second end lip 1292 may help retain the recording device 1212 in the central bore 1218. In some embodiments, the recording device 1212 may be retained or secured by compression resulting from the connection of the pin 1291 and the bit head 1290. For example, the pin 1291 and the bit head 1290 may have a threaded connection. When the threaded connection is tightened, the second end lip 1292 may be compressed between the pin 1291 and the bit head 1290. In other examples, the bit head 1290 may be brazed or welded to the pin 1291, and the recording device 1212 brazed or welded to the pin 1291 and the bit head 1290.

In some embodiments, the second end lip 1292 may include a bevel from outside the housing centralizer 1214 to inside the housing centralizer 1214. This bevel may help reduce erosion at the contact between the second end lip 1292 and the bit head 1290. In some embodiments, the pin 1291 and the bit head 1290 may be contoured to the outer surface of the recording device 1212 such that the first bore diameter 1282-1 is the same as the housing centralizer inner diameter 1252. Thus, the flow 1238 of drilling fluid may experience the same diameter throughout the central bore 1218 and the annular space 1224.

Figure 13:
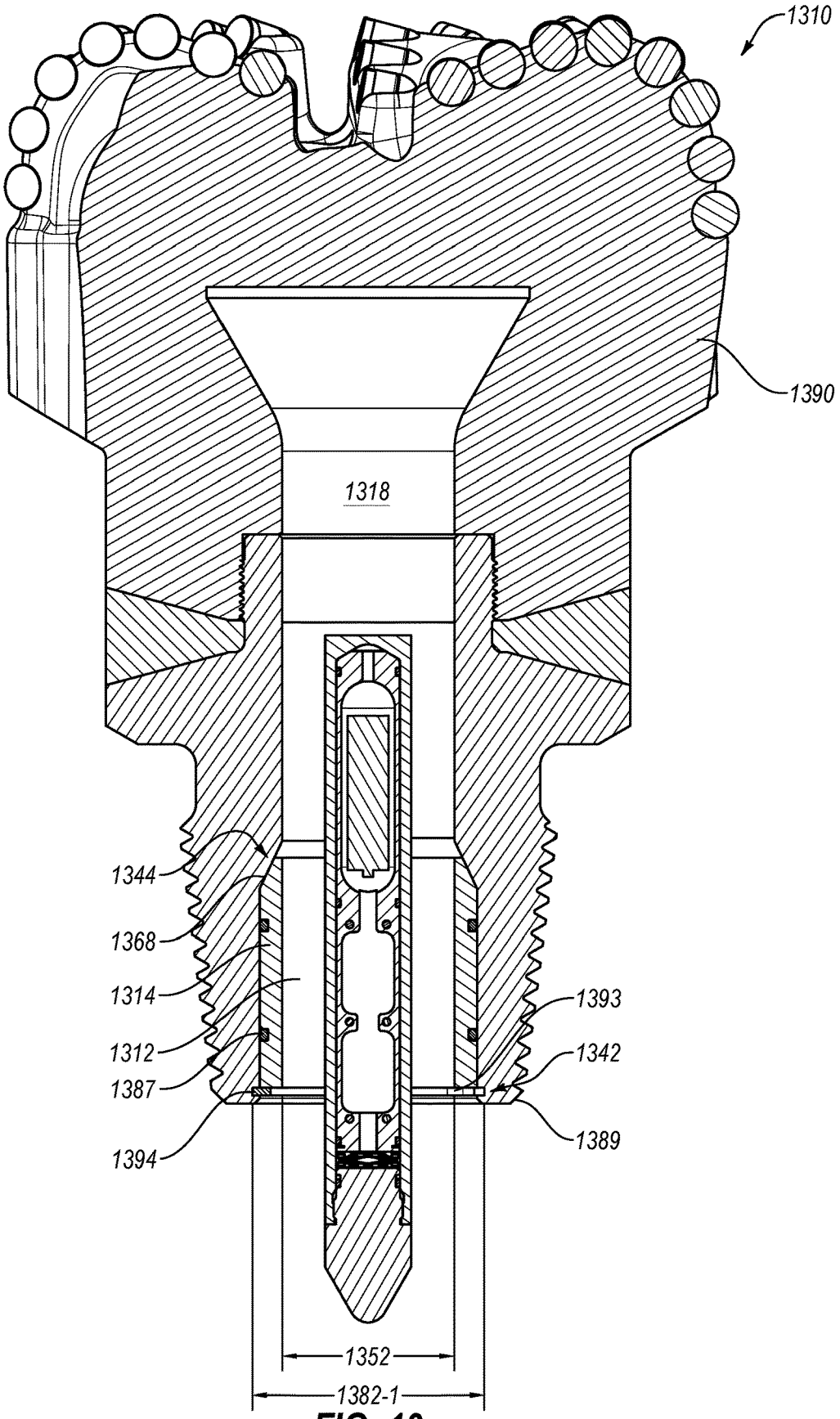
FIG. 13 is a longitudinal cross-sectional view of a further bit and recording device, according to at least one embodiment of the present disclosure.

FIG. 13 represents a longitudinal cross-sectional view of a bit 1310 with a recording device 1312 installed in the central bore 1318 of the bit head 1390. The recording device 1312 may include any of the recording devices described in relation to FIGS. 2 to 9-3, such as a second end bevel 1368 or one or more sealing rings 1387. In some embodiments, the recording device 1312 is connected to the bit 1310 using a retaining ring 1393. The recording device 1312 may be inserted into the central bore 1318. The uphole end 1389 of the bit 1310 may include a slot 1394. The recording device 1312 may be inserted into the central bore 1318 to a depth such that the housing centralizer first end 1342 may be downhole of the slot 1394. In other words, the housing centralizer first end 1342 may clear the slot 1394. After the recording device 1312 has been inserted into the central bore 1318 past the slot 1394, the retaining ring 1393 may be inserted into the slot 1394, thereby securing the recording device 1312 in the central bore 1318.

In some embodiments, the first bore diameter 1382-1 is the same as or close to the same as the housing centralizer outer diameter 1350, allowing the recording device 1312 to be inserted with a tight or friction fit into the central bore 1318. In some embodiments, the slot 1394 has a slot diameter that is greater than the first bore diameter 1382-1.

In some embodiments, the retaining ring 1393 is a non-continuous ring having a first relaxed diameter. A gap in the ring may be closed, thereby reducing the diameter of the retaining ring to a second compressed diameter. In some embodiments, the first relaxed diameter is greater than the first bore diameter 1382-1. In some embodiments, the first relaxed diameter is greater than the slot diameter. In other embodiments, the first relaxed diameter is less than the slot diameter. In some embodiments, the second compressed diameter is less than the first bore diameter 1382-1. The retaining ring 1393 having the second compressed diameter may be inserted into the central bore 1318. The retaining ring 1393 may then be relaxed, moving from the second compressed diameter to the first relaxed diameter in the slot 1394, thereby securing the recording device 1312 in the central bore 1318.

In some embodiments the central bore 1318 matches the contour of the outer surface of the housing centralizer 1314. The central bore 1318 may be reduced from the first bore diameter 1382-1 to the second bore diameter 1382-2 at the housing centralizer second end 1344. In some embodiments, the second bore diameter 1382-2 may be the same as the housing centralizer inner diameter 1352.

In some embodiments, the recording device may be secured to the bit using two or more of the structures discussed in relation to FIGS. 10-13. For example, the recording device may be secured to the bit using a threaded connection (e.g., threaded connection 1080 of FIG. 10) and a retaining ring (e.g., retaining ring 1393 of FIG. 13). In other examples, the recording device may be secured to the bit using a mechanical connection (e.g., mechanical connector 1186 of FIG. 11) and be built in between the bit head and the pin (e.g., compressed as in FIG. 12). In still other examples, the recording device may be secured to the bit using a threaded connection, a mechanical connection, and a retaining ring. In yet other examples, the recording device may be secured to the bit using any combination of connections discussed in the present disclosure.

The recording device may also occupy any of a number of different positions within or outside of a bit. For instance, a recording device may be positioned entirely longitudinally within a bit or other downhole tool, such that the uphole end of the recording device is downhole from the uphole end of the bit (see FIG. 12). In other embodiments, is entirely within the bit, with an uphole end of the recording device about flush with the uphole end of the bit (see FIGS. 10 and 11). In still other embodiments, the uphole end of the recording device extends out of the bit (see FIG. 13).

Figure 14:
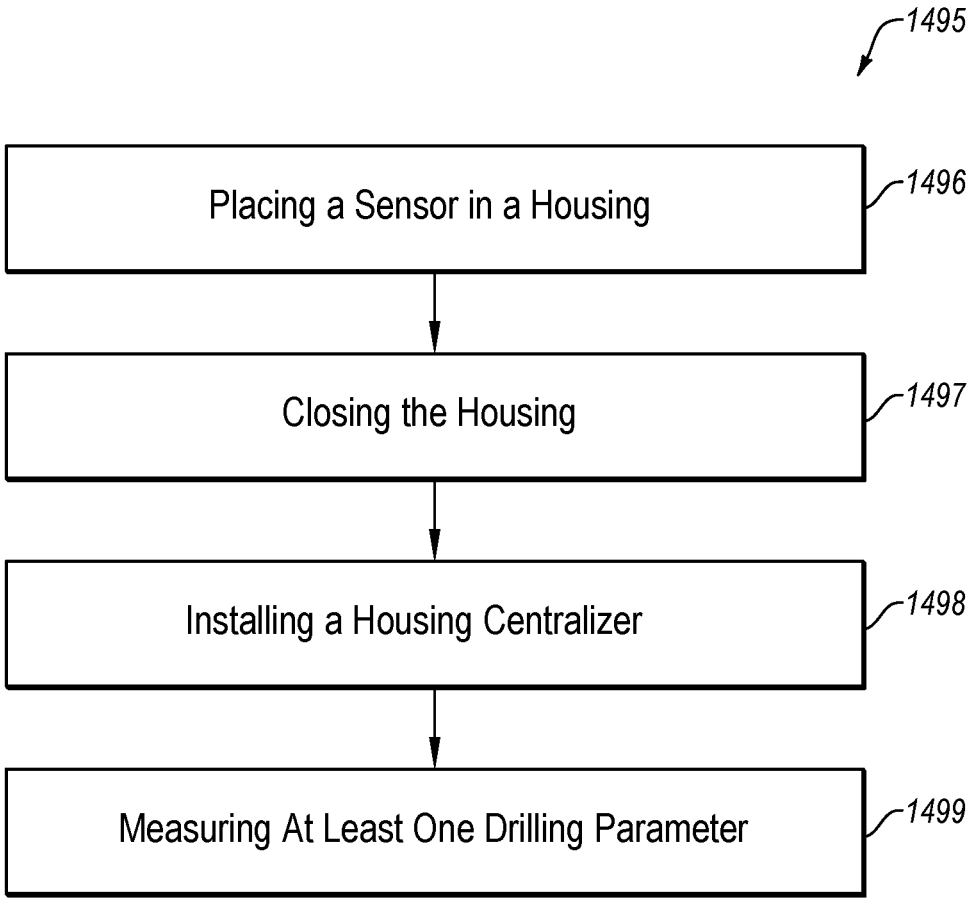
FIG. 14 is a method chart of a method for measuring a downhole parameter, according to at least one embodiment of the present disclosure.

FIG. 14 depicts a method 1495 for measuring downhole parameters. The method 1495 includes placing at least one sensor in a housing at 1496 and closing the housing with a sealing member at 1497. A housing centralizer may then be installed in a bit at 1498, including in any manner described in the present disclosure. The housing centralizer may be installed such that a longitudinal axis of the housing (e.g., housing longitudinal axis 220 of FIG. 2) is the same as a longitudinal axis of the bore (e.g., bore longitudinal axis 222 of FIG. 2). The method 1495 may also include measuring at least one drilling parameter at 1499. Measuring at least one drilling parameter may include measuring at least one of temperature, shock and vibration or 'accelerations', rotation, angular acceleration (or rate of change of rotation), inclination, or combinations thereof. In at least some embodiments, measuring at least one drilling parameter also includes recording the at least one drilling parameter in persistent storage. The persistent storage may be located on the device containing the sensor, at another location on a downhole tool, or at a remote location. The recorded data may be raw data, or it may be processed into a suitable format. Drilling parameters may be measured (and thus recorded) continuously, intermittently, when trigger events occur, or at any other suitable intervals.

Figure 15:
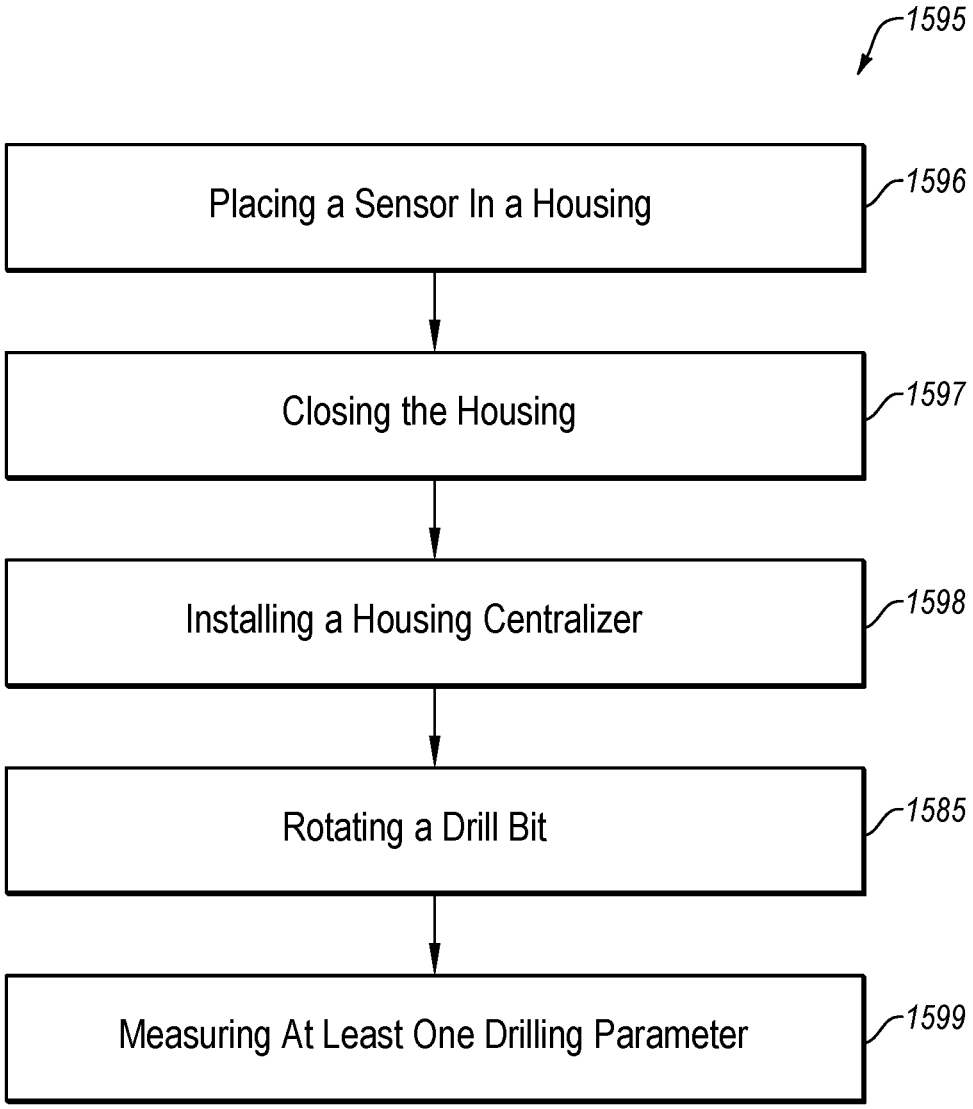
FIG. 15 is a method chart of another method for measuring a downhole parameter, according to at least one embodiment of the present disclosure.

FIG. 15 depicts a method 1595 for measuring downhole parameters. The method 1595 includes placing at least one sensor in a housing at 1596 and closing the housing with a sealing member at 1597. A housing centralizer may then be installed in a bit at 1598, including in any manner described herein. The housing centralizer may be installed such that a longitudinal axis of the housing (e.g., housing longitudinal axis 220 of FIG. 2) is the same as a longitudinal axis of the bore (e.g., bore longitudinal axis 222 of FIG. 2). The method 1595 may include rotating the bit at 1585. Rotating the bit may include rotating the bit around the longitudinal axis of the bore. In some embodiments, rotating the bit includes rotating the bit around the longitudinal axis of the housing. In some embodiments, rotating the bit includes rotating the bit around both the longitudinal axis of the housing and the bore. In the same or other embodiments, the bit, housing, and sensor may be rotationally locked, such that rotating the bit includes rotating the bit, housing, and sensor at a same rotational speed. The method 1595 may also include measuring at least one drilling parameter at 1599. In some embodiments, measuring may include measuring the at least one drilling parameter while rotating the bit. Measuring the at least one drilling parameter at 1599 may also include recording or otherwise storing the measured at least one drilling parameter.

Figure 16:
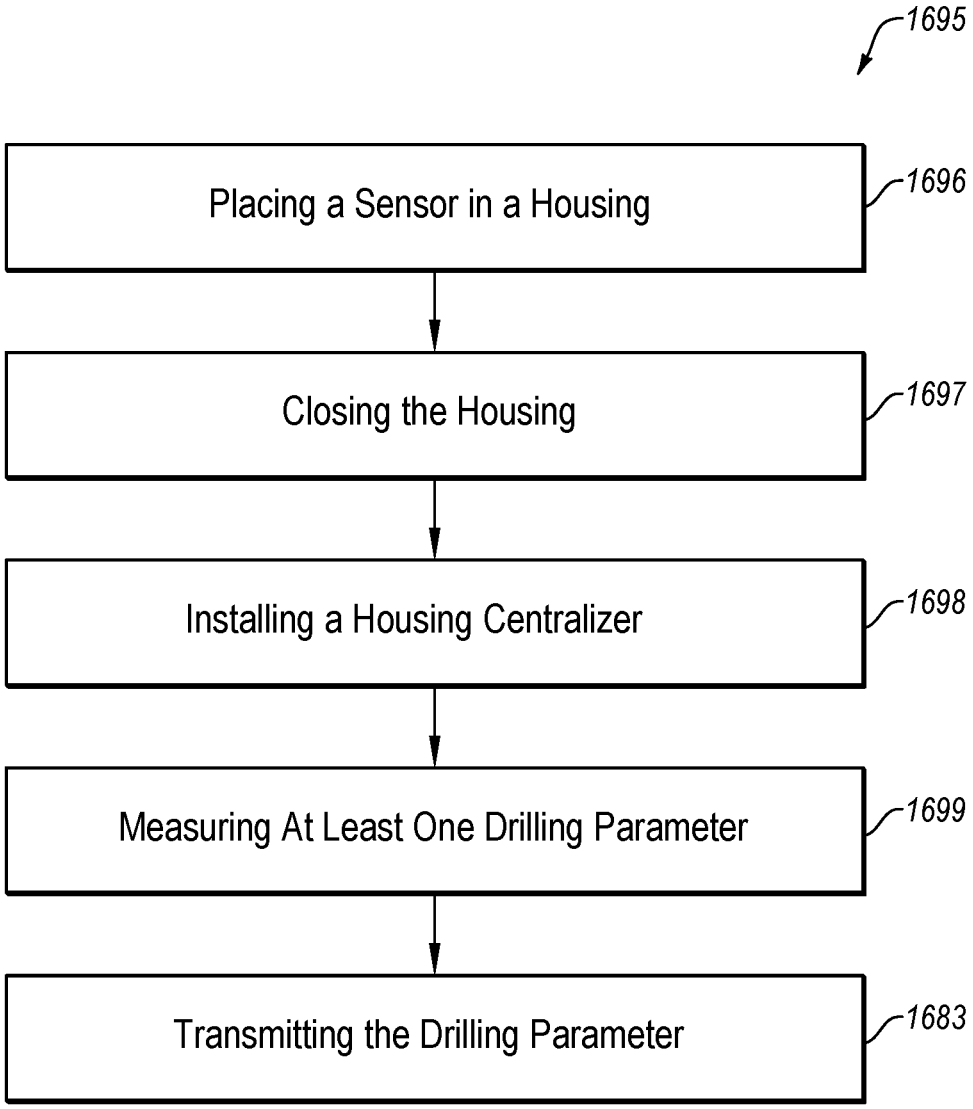
FIG. 16 is a method chart of an additional method for measuring a downhole parameter, according to at least one embodiment of the present disclosure.

FIG. 16 depicts a method 1695 for measuring downhole parameters. The method 1695 includes placing at least one sensor in a housing at 1696 and closing the housing with a sealing member at 1697. The housing centralizer may then be installed in a bit, as described in the present disclosure, at 1698. The housing centralizer may be installed such that a longitudinal axis of the housing (e.g., housing longitudinal axis 220 of FIG. 2) is the same as a longitudinal axis of the bore (e.g., bore longitudinal axis 222 of FIG. 2). The method 1695 may also include measuring at least one drilling parameter at 1699 (and optionally recording the at least one drilling parameter). The method 1695 may also include transmitting the drilling parameter to the surface at 1683.

The embodiments of the recording device have been primarily described with reference to wellbore drilling operations; the recording device described herein may be used in applications other than the drilling of a wellbore. In other embodiments, the recording device according to the present disclosure may be used outside a wellbore or other downhole environment used for the exploration or production of natural resources. For instance, recording device of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole recording device, comprising:

a housing centralizer having a first end and a second end, the housing centralizer having an annular shape and defining an annular space therein;

a chassis positioned radially within the annular space, the chassis connected to the housing centralizer by at least one radial connector, the chassis including a sensor mounting portion, wherein the at least one radial connector is attached to the chassis and to the housing centralizer by an attachment mechanism comprising: a weld, a braze, a mechanical fastener, a cast one piece connection, a molded one piece connection, a machined one piece connection, or any combination thereof; and the annular space radially between the housing centralizer and the chassis, the annular space extending axially through the housing centralizer and allowing fluid communication through the first end to the second end of the housing centralizer.

2. The device of claim 1, the chassis including at least one downhole sensor coupled to the sensor mounting portion.

3. The device of claim 1, the housing centralizer including an end bevel.

4. The device of claim 1, the at least one radial connector including a plurality of radial connectors, the plurality of radial connectors being rotationally balanced around the chassis.

5. The device of claim 1, the at least one radial connector being thicker adjacent the chassis than adjacent the housing centralizer.

6. A downhole tool, comprising:

a downhole tool having a central bore; and a downhole recording device positioned in the central bore and positioned entirely longitudinally within the downhole tool, the downhole recording device including:

a housing centralizer having an inner surface and an outer surface extending from a first end to a second end, the inner surface defining an annular space, and the outer surface is generally cylindrical and interfaces with the central bore;

a housing positioned radially within the annular space, the housing including a sensor mounting portion and being connected to the inner surface of the housing centralizer by at least one connector; and the annular space radially between the housing centralizer and the housing, the annular space allowing fluid communication through the first end to the second end of the housing centralizer.

7. The downhole tool of claim 6, the at least one connector being rotatable relative to the housing centralizer about a longitudinal axis.

8. The downhole tool of claim 6, the housing having a removable sealing member with a rounded top section at a housing first end.

9. The downhole tool of claim 6, the downhole tool having an occlusion percentage of less than 30%.

10. The downhole tool of claim 6, wherein the at least one connector is attached to the housing and to the housing centralizer by an attachment mechanism comprising: a weld, a braze, a mechanical fastener, a cast one piece connection, a molded one piece connection, a machined one piece connection, or any combination thereof.

11. A system for measuring downhole parameters, comprising:

a bit having a central bore and a rotational axis, the central bore being generally cylindrical and having an inside surface with a first bore diameter; and a downhole recording device positioned in the central bore, the downhole recording device including:

a housing centralizer secured to the bit in the central bore, wherein the housing centralizer is positioned entirely longitudinally within the bit, wherein the housing centralizer comprises:

an outer surface having an outer diameter that interfaces with the first bore diameter of the central bore, wherein the outer surface is generally cylindrical; and an inner surface defining an annular space;

a housing connected to the inner surface of the housing centralizer using at least one radial connector, the housing including a chassis and at least one sensor coupled to the chassis; and the annular space located radially between the housing centralizer and the housing, with the at least one radial connector positioned in the annular space, wherein the annular space allows fluid communication through the downhole recording device and into the central bore.

12. The system of claim 11, the housing having a sealing member on a first end, and being closed on a second end.

13. The system of claim 11, the housing including a resilient member between a sealing member and the at least one sensor.

14. The system of claim 11, the housing centralizer including at least one locking feature rotationally locking the housing centralizer with respect to the central bore.

15. The system of claim 11, wherein the outer surface of the housing centralizer comprises a pin thread secured to a box thread on the inside surface of the central bore with the first bore diameter.

16. The system of claim 11, the housing centralizer being secured to the bit with a mechanical connector.

17. The system of claim 11, the bit including a bit head connected to a pin, the housing centralizer being connected to the bit by compression between the bit head and the pin.

18. The system of claim 11, the housing centralizer being secured to the bit using a retaining ring at an uphole end of the bit.

19. The system of claim 11, the housing centralizer including at least one sealing ring between the housing centralizer and the central bore.

20. The system of claim 11, the inside surface of the central bore having a first section with the first bore diameter and a second section having a second bore diameter that is less than the first bore diameter, wherein an inner diameter of an inner surface of the housing centralizer is the same as the second bore diameter, and the second section is downhole of the first section.

* * * * *